US010324408B2

(12) United States Patent
Sato et al.

(10) Patent No.: US 10,324,408 B2
(45) **Date of Patent: *Jun. 18, 2019**

(54) IMAGE FORMING APPARATUS

(71) Applicant: Brother Kogyo Kabushiki Kaisha, Nagoya-shi, Aichi-ken (JP)

(72) Inventors: Shougo Sato, Seto (JP); Keisuke Takahashi, Nagoya (JP); Kazutoshi Kotama, Toyota (JP); Hikaru Yoshizumi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/359,720

(22) Filed: Nov. 23, 2016

(65) Prior Publication Data

US 2017/0075281 A1 Mar. 16, 2017

Related U.S. Application Data

(63) Continuation of application No. 14/458,699, filed on Aug. 13, 2014, now Pat. No. 9,507,309.

(30) Foreign Application Priority Data

Aug. 13, 2013 (JP) ..... 2013-168351

(51) Int. Cl.

| | |
|---|---|
| ***B65H 1/04*** | (2006.01) |
| ***B65H 11/02*** | (2006.01) |
| ***G03G 15/00*** | (2006.01) |
| ***G03G 21/16*** | (2006.01) |

(52) U.S. Cl.

CPC ..... *G03G 15/6529* (2013.01); *B65H 1/04* (2013.01); *G03G 15/6502* (2013.01); (Continued)

(58) Field of Classification Search

CPC .. B65H 11/02; B65H 11/00; B65H 2402/441; B65H 1/04; B65H 2407/21; (Continued)

(56) References Cited

U.S. PATENT DOCUMENTS

| | | | |
|---|---|---|---|
| 5,602,623 | A | 2/1997 | Nishibata et al. |
| 6,040,919 | A | 3/2000 | Iwata et al. |

(Continued)

FOREIGN PATENT DOCUMENTS

| | | | |
|---|---|---|---|
| JP | S61-279870 | A | 12/1986 |
| JP | H03-061216 | A | 3/1991 |

(Continued)

OTHER PUBLICATIONS

Apr. 25, 2017—(JP) Office Action—App 2013-168351.

*Primary Examiner* — Justin Seo
*Assistant Examiner* — John M Royston
(74) *Attorney, Agent, or Firm* — Banner & Witcoff, Ltd.

(57) ABSTRACT

There is provided an image forming apparatus including a casing which includes one side wall extending in a vertical direction and has a first opening; and a discharge portion which receives a recording medium having a developer image formed thereon, and a cassette which accommodates recording media and is removably mounted to the casing. The casing further includes a tray which is disposed near the one side wall and receives a recording medium to be transported into the casing through the first opening. The tray is rotatable between a first position where the tray is bent so as to cover at least part of the one side wall and the discharge portion and a second position where the tray extends so as to be separated from the one side wall and receives a recording medium to be supplied into the casing through the first opening.

16 Claims, 8 Drawing Sheets

(52) U.S. Cl.
CPC ..... *G03G 15/6514* (2013.01); *G03G 21/1695* (2013.01); *B65H 11/02* (2013.01); *B65H 2402/441* (2013.01); *B65H 2405/324* (2013.01); *B65H 2407/21* (2013.01); *G03G 21/1623* (2013.01); *G03G 21/1633* (2013.01); *G03G 2215/00544* (2013.01)

(58) Field of Classification Search
CPC ..... B65H 2405/324; G03G 21/1623; G03G 21/1633; G03G 15/6529; G03G 15/6502; G03G 15/6514; G03G 21/1695; G03G 2215/00544
See application file for complete search history.

(56) References Cited

U.S. PATENT DOCUMENTS

| | | | | |
|---|---|---|---|---|
| 6,547,288 | B1 | 4/2003 | Ito et al. | |
| 7,484,722 | B2 | 2/2009 | Ishii | |
| 7,748,706 | B2 | 7/2010 | Ishii | |
| 2002/0094217 | A1* | 7/2002 | Miyamoto | G03G 15/0194 399/299 |
| 2004/0091290 | A1* | 5/2004 | Yamada | G03G 15/0121 399/284 |
| 2005/0141939 | A1 | 6/2005 | Kayama et al. | |
| 2006/0140669 | A1* | 6/2006 | Sato | G03G 21/1839 399/110 |
| 2006/0269320 | A1 | 11/2006 | Ishii | |
| 2007/0020017 | A1 | 1/2007 | Okoshi | |
| 2009/0116889 | A1 | 5/2009 | Ishii | |

FOREIGN PATENT DOCUMENTS

| | | | |
|---|---|---|---|
| JP | H06-010256 | U | 2/1994 |
| JP | H06-089069 | A | 3/1994 |
| JP | H10-126544 | A | 5/1998 |
| JP | 2005-017425 | A | 1/2005 |
| JP | 2006-337570 | A | 12/2006 |
| JP | 2010-266724 | A | 11/2010 |

* cited by examiner

IMAGE FORMING APPARATUS

CROSS-REFERENCE TO RELATED APPLICATION

This application is a continuation of U.S. patent application Ser. No. 14/458,699, filed Aug. 13, 2014, which claims priority from Japanese Patent Application No. 2013-168351, filed on Aug. 13, 2013, the entire subject matter of which is incorporated herein by reference.

TECHNICAL FIELD

Aspects of the present invention relate to an image forming apparatus which employs an electro-photographic method.

BACKGROUND

A related-art image forming apparatus includes a sheet feed tray and a manual feed tray.

For example, JP-A-2005-017425 discloses a printer including a sheet feed tray and a manual feed tray and achieves space saving by accommodating a manual feed tray when a sheet feed tray is used.

Specifically, the printer accommodates the manual feed tray so that the manual feed tray is rotated upward with a lower end thereof as a fulcrum and is disposed along a front wall of the printer.

However, in the printer disclosed in JP-2005-017425, since the manual feed tray is accommodated so as to be disposed along the front wall of the printer, that is, the manual feed tray extends in a vertical direction, a size of the printer is increased in the vertical direction due to the vertical extension of the manual feed tray, and thus size-reduction in the vertical direction is restricted.

SUMMARY

Accordingly, an aspect of the present invention provides an image forming apparatus which can achieve size-reduction in a vertical direction.

According to an illustrative embodiment of the present invention, there is provided an image forming apparatus comprising a casing and a cassette. The casing includes one side wall extending in a vertical direction and having a first opening; and a discharge portion configured to receive a recording medium having a developer image formed thereon. The cassette is configured to accommodate recording media and is removably mounted to the casing. The casing further includes a tray which is disposed near the one side wall and is configured to receive a recording medium so as to be transported into the casing through the first opening. The tray is configured to be rotatable between a first position where the tray is bent so as to cover at least part of the one side wall and the discharge portion of the casing and a second position where the tray extends so as to be separated from the one side wall of the casing and is configured to receive a recording medium to be supplied into the casing through the first opening.

According to this configuration, when the tray is used, if the tray is located at the second position, the tray can receive a recording medium and the recording medium can be supplied into the casing through the first opening of the one side wall.

Additionally, if the tray is located at the first position, the tray is bent so as to cover at least part of one side wall and the discharge portion of the casing. That is, when the tray is not used, the tray can be located at the first position so as to be accommodated.

Therefore, the tray does not extend in the vertical direction, and thus it is possible to achieve size-reduction of the image forming apparatus in the vertical direction.

According to the above-described image forming apparatus, it is possible to achieve size-reduction in the vertical direction.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

1. Overall Configuration of Printer

Figure 1:
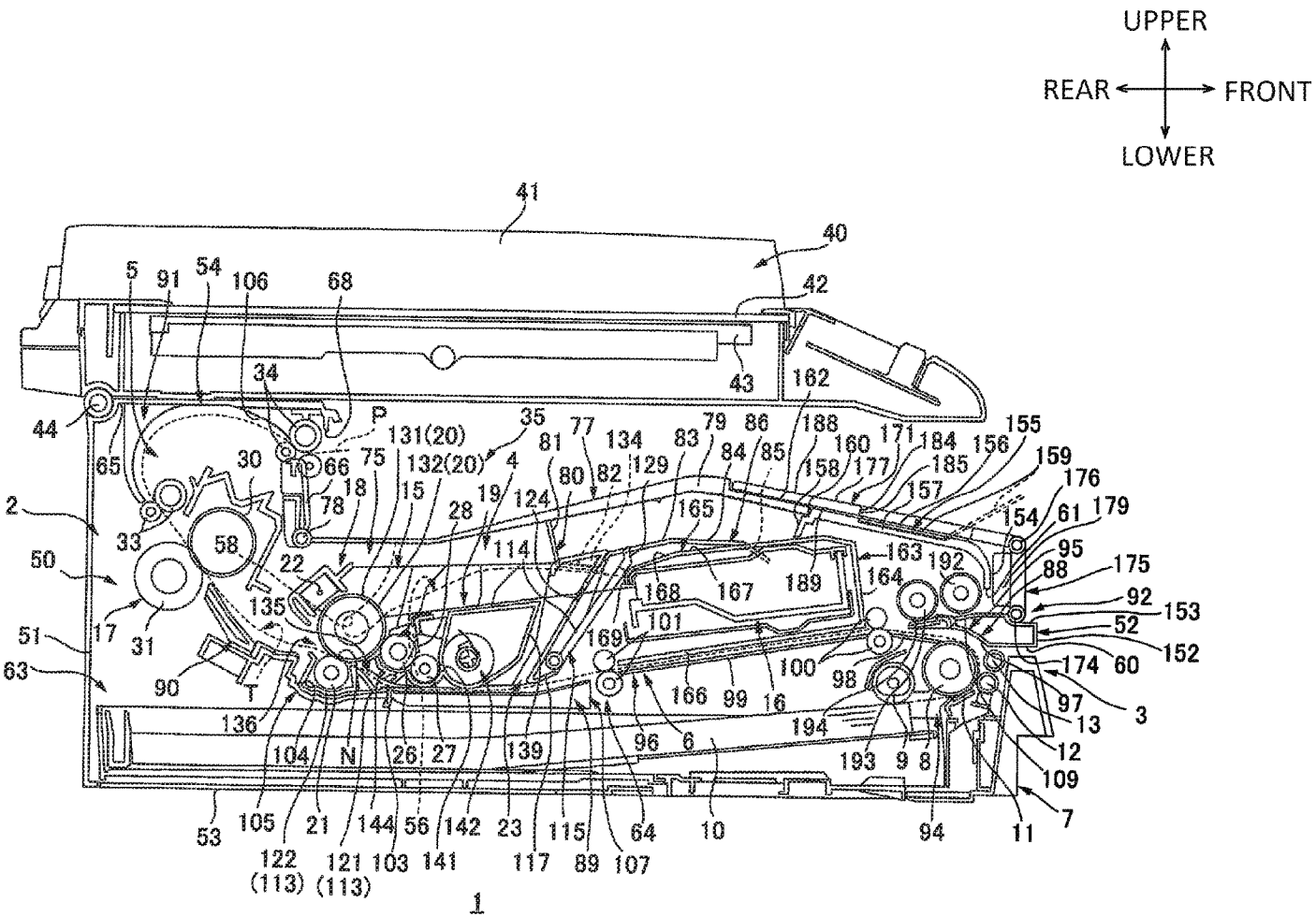
FIG. 1 is a center cross-sectional view showing a printer as an image forming apparatus according to a first illustrative embodiment of the present invention, and shows a state where a process cartridge is located at an internal position.

As shown in FIG. 1, a printer 1 includes a main body casing 2, a sheet feed section 3, an image forming section 4, a sheet discharge section 5, a sheet guide section 6, and a flat bed scanner 40.

In the following description, when directions are mentioned, the right side of FIG. 1 is referred to as the front side, and the left side of FIG. 1 is referred to as the rear side, with a state of the printer 1 being horizontally placed as a reference. Further, with a state of the printer 1 being viewed from the front side as a reference of left and right sides, the front side of FIG. 1 is referred to as the left side, and a back side of FIG. 1 is referred to as the right side.

For a process cartridge 15, front and rear sides, left and right sides, and upper and lower sides are defined with a mounted state of the process cartridge 15 in a main body casing 2 (described later) as a reference. Specifically, directions in each drawing are indicated by arrows.

Incidentally, a left-right direction is an example of a first direction, the left side is one side of the first direction, and the right side is the other side of the first direction. Further, a front-rear direction is an example of a second direction, the front side is one side of the second direction, and the rear side is the other side of the second direction. Furthermore, an upper-lower direction is the same direction as a vertical direction.

The main body casing 2 has a substantially box shape which extends in the left-right direction, and accommodates the sheet feed section 3, the image forming section 4, the sheet discharge section 5, and the sheet guide section 6 in an inner space thereof.

The sheet feed section 3 supplies a sheet P to the image forming section 4. The sheet feed section 3 is disposed at a lower part in the main body casing 2. The sheet feed section 3 includes a sheet feed cassette 7 and a sheet feed roller 8.

Figure 3:
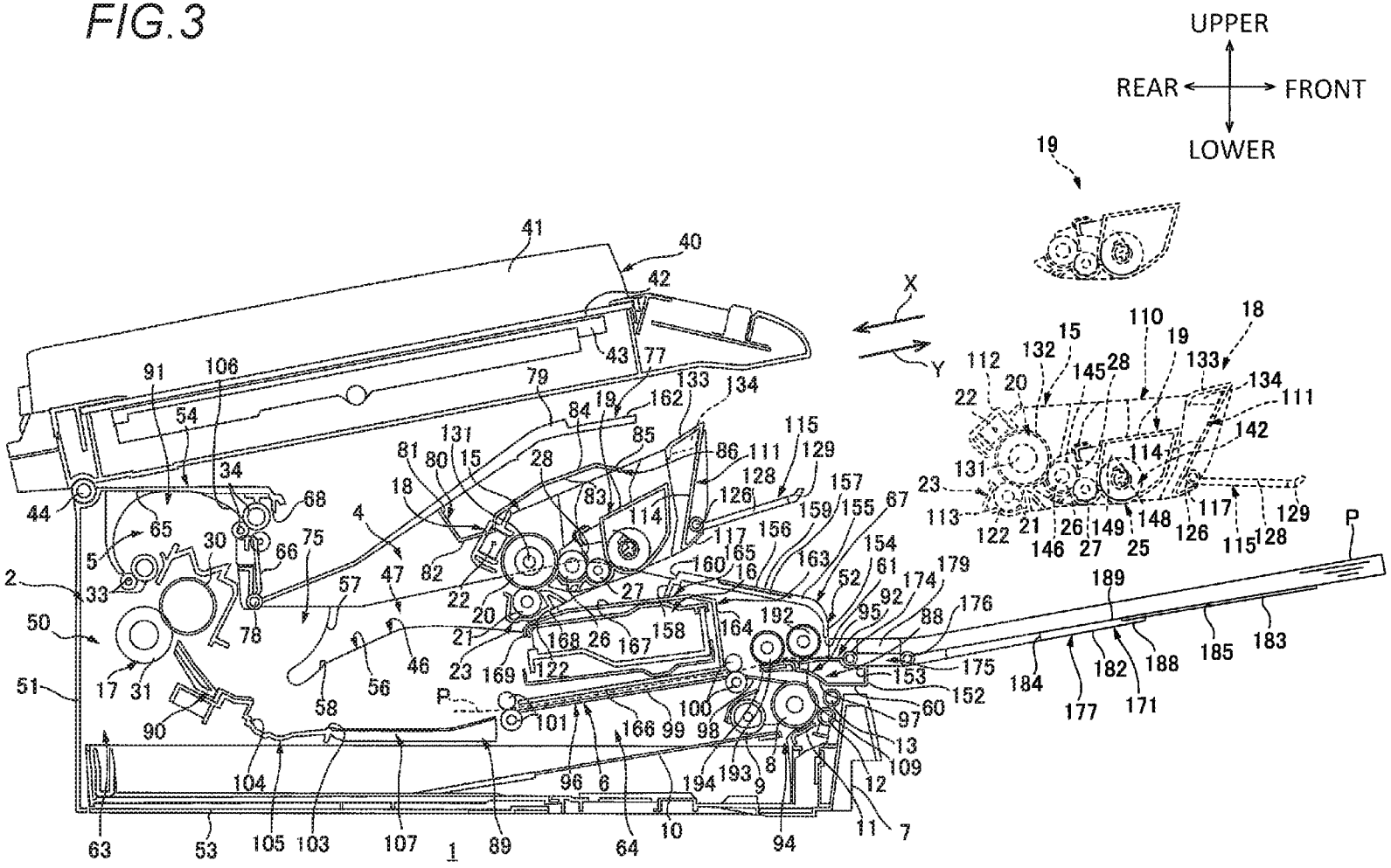
FIG. 3 is a center cross-sectional view of the printer shown in FIG. 1, and shows a state where the process cartridge is located between the extraction position and an external position and a state where the process cartridge is located at the external position.

As shown in FIGS. 1 and 3, the sheet feed cassette 7 is disposed at a lower end in the main body casing 2, and is removably mounted in the main body casing 2. As shown in FIG. 1, the sheet feed cassette 7 has a substantially box shape which is opened upward, and accommodates a plurality of sheets P which are supplied to a process cartridge 15 (described later). Incidentally, although described later in detail, the sheet feed cassette 7 supports a sheet lift 10, a sheet feed pad 11, and a first pinch roller 12.

The sheet feed roller 8 has a substantially columnar shape which extends in the left-right direction. The sheet feed roller 8 is disposed on the upper side with respect to a front end of the sheet feed cassette 7, and is disposed further forward than the process cartridge 15.

The image forming section 4 forms an image on the sheet P. The image forming section 4 is disposed on the upper side of the sheet feed section 3 in the main body casing 2. The image forming section 4 includes the process cartridge 15, a scanner unit 16, and a fixing unit 17.

Although described later in detail, the process cartridge 15 can be moved between an internal position where the process cartridge 15 lies in the main body casing 2 and an external position where the process cartridge 15 is removed from the main body casing 2. In a state of being located at the internal position, the process cartridge 15 is disposed at a substantially center in a side view in the main body casing 2, and is disposed on the upper side with respect to a substantially center part of the sheet feed cassette 7 in the front-rear direction. That is, the sheet feed cassette 7 is disposed on the lower side with respect to the process cartridge 15.

The process cartridge 15 includes a drum cartridge 18 and a developing cartridge 19.

The drum cartridge 18 includes a photosensitive drum 20, a transfer roller 21, and a scorotron charger 22. The photosensitive drum 20 is disposed at a rear end of the drum cartridge 18. The transfer roller 21 is disposed on the lower side of the photosensitive drum 20. An upper end of the transfer roller 21 is in contact with a lower end of the photosensitive drum 20. The scorotron charger 22 is disposed with respect to the photosensitive drum 20 with a slight gap therebetween on the rear upper side of the photosensitive drum 20.

Figure 7A:
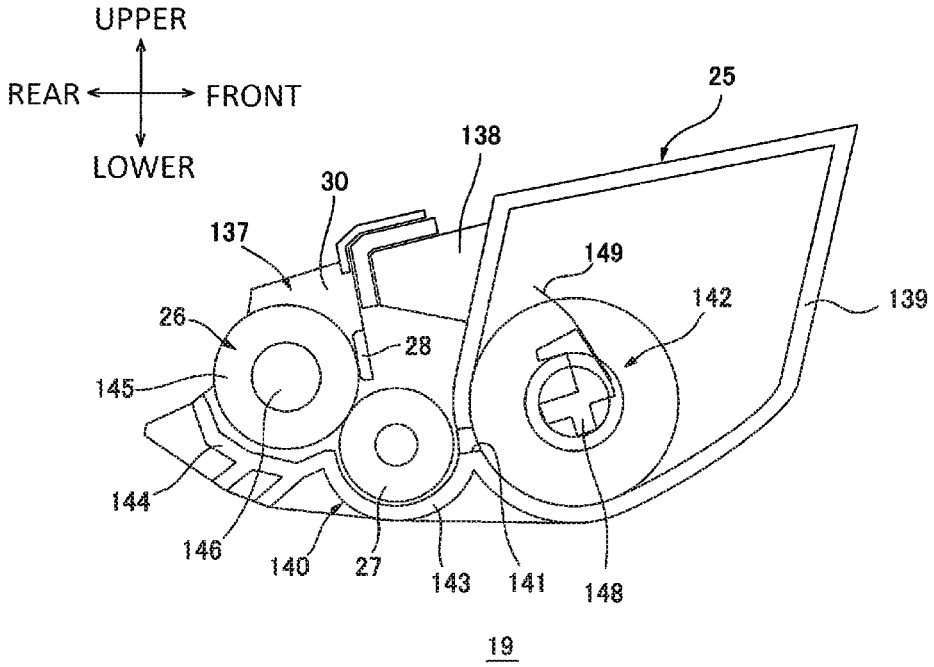
FIG. 7A is a center cross-sectional view of a developing cartridge shown in FIG. 1.

As shown in FIG. 7A, the developing cartridge 19 includes a developing roller 26, a supply roller 27, and a layer thickness regulation blade 28, and accommodates toner.

The developing roller 26 has a substantially columnar shape extending in the left-right direction, and is disposed at a rear end of the developing cartridge 19. An upper part and a rear part of the developing roller 26 are exposed from the developing cartridge 19 as shown in FIG. 1, and a rear upper end of the developing roller 26 is in contact with a front lower end of the photosensitive drum 20.

As shown in FIG. 7A, the supply roller 27 has a substantially columnar shape extending in the left-right direction, and is disposed on the front lower side with respect to the developing roller 26. A rear upper end of the supply roller 27 is in pressing contact with a front lower end of the developing roller 26.

The layer thickness regulation blade 28 is disposed on the front upper side of the developing roller 26. The layer thickness regulation blade 28 has a plate shape extending in the upper-lower direction in a side view. Further, a lower end of the layer thickness regulation blade 28 is in contact with a front end of the developing roller 26.

As shown in FIG. 1, the scanner unit 16 is disposed on the front side with respect to the process cartridge 15, and is disposed on the upper side with respect to the sheet feed roller 8 with an interval therebetween. That is, the feed roller 8 is disposed on the front side with respect to the process cartridge 15. Specifically, the scanner unit 16 is disposed so as to overlap the process cartridge 15 and the fixing unit 17 when projected in the front-rear direction, and is disposed so as to overlap the sheet feed roller 8 when projected in the upper-lower direction. In addition, the scanner unit 16 is disposed in a direction which connects the front upper side to the rear lower side so as to be inclined downward toward the rear side. Further, the scanner unit 16 emits a laser beam L based on image data toward the photosensitive drum 20 as indicated by a solid line of FIG. 1.

The fixing unit 17 is disposed on the rear upper side with respect to the process cartridge 15 with an interval therebetween. That is, the fixing unit 17 is disposed further rearward than the process cartridge 15. The fixing unit 17 includes a heating roller 30 and a pressing roller 31.

The heating roller 30 is disposed on the rear upper side with respect to the scorotron charger 22 of the process cartridge 15 with an interval therebetween. The pressing roller 31 is disposed on the rear lower side with respect to the heating roller 30. A front upper end of the pressing roller 31 is in pressing contact with a rear lower end of the heating roller 30.

The sheet discharge section 5 is disposed on the upper side with respect to the fixing unit 17. The sheet discharge section 5 includes a pair of guide rollers 33 and a pair of sheet discharge rollers 34.

The pair of guide rollers 33 are disposed on the rear upper side with respect to the fixing unit 17 with an interval therebetween. Each of the pair of guide rollers 33 has a substantially columnar shape extending in the left-right direction, and the guide rollers 33 are in contact with each other in a direction which connects the front upper side to the rear lower side.

The pair of sheet discharge rollers 34 are disposed on the front upper side with respect to the fixing unit 17 with an interval therebetween, and is disposed further rearward than the photosensitive drum 20. That is, the pair of sheet discharge rollers 34 are disposed further upward than the fixing unit 17, and further rearward than the sheet feed roller 8. Each of the pair of sheet discharge rollers 34 has a substantially columnar shape extending in the left-right direction, and the sheet discharge rollers 34 are in contact with each other in a direction which connects the front upper side to the rear lower side.

Although described later in detail, the sheet guide section 6 guides transport of the sheet P so that the sheet P is transported from the sheet feed cassette 7 by the sheet feed roller 8 to reach the sheet discharge rollers 34 through a contact point N between the photosensitive drum 20 and the transfer roller 21. The sheet guide section 6 defines a transport path T in a substantially S shape in a side view.

The flat bed scanner 40 is disposed adjacent to the main body casing 2 on the upper side, and is disposed on the upper side with respect to a sheet discharge tray 35 (described later) with an interval therebetween. The flat bed scanner 40 includes a shaft portion 44, a pressing cover 41, a glass surface 42, and a CCD sensor 43.

The shaft portion 44 is provided at a rear lower end of the flat bed scanner 40. The shaft portion 44 has a substantially columnar shape extending in the left-right direction, and is rotatably supported at a rear upper end of the main body casing 2. Thus, the flat bed scanner 40 swings with respect to the main body casing 2 with the shaft portion 44 as a fulcrum.

The flat bed scanner 40 has a configuration in which an original document is placed between the pressing cover 41 and the glass surface 42, and then image information of the original document is read by the CCD sensor 43.

2. Details of Main Body Casing

As shown in FIG. 3, the main body casing 2 includes a pair of side walls 50, a rear wall 51, a front wall 52, a bottom wall 53, and a top wall 54, which are integrally formed.

The pair of side walls 50 are respectively disposed at both left and right ends of the main body casing 2, and are disposed with an interval therebetween in the left-right direction. Each of the pair of side walls 50 has a substantially L plate shape in a side view. Specifically, a rear part 63 of the side walls 50 has a substantially rectangular shape extending in the upper-lower direction in a side view. A front part 64 of the side walls 50 has a substantially rectangular shape extending in the front-rear direction in a side view, and extends forward from a lower part of a front edge of the rear part 63.

Further, each of the pair of side walls 50 includes a groove 46.

The grooves 46 are disposed on inner surfaces in the left-right direction of the front parts 64 of the respective side walls 50 so as to match each other when projected in the left-right direction. In the present illustrative embodiment, configurations of the grooves 46 are the same as each other in the pair of side walls 50. Therefore, in the following description of the grooves 46, the groove 46 disposed on the right side wall 50 will be described in detail, and description of the groove 46 disposed on the left side wall 50 will be omitted.

The groove 46 is recessed outward in the left-right direction on the inner surface in the left-right direction of the front part 64 of the side wall 50 and is opened upward. The groove 46 includes a first groove 47 and a second groove 56.

The first groove 47 is located at an upper part of the groove 46, and is disposed at an upper part on the inner surface in the left-right direction of the front part 64 of the side wall 50. A front end of the first groove 47 is disposed with respect to the rear part of the scanner unit 16 with an interval therebetween in the left-right direction.

The first groove 47 has a substantially rectangular shape extending in the front-rear direction in a side view, and is recessed downward from an upper edge of the front part 64 of the side wall 50.

The second groove 56 is a lower part of the groove 46, and is connected to a rear lower end of the first groove 47 and extends toward the rear lower side. Thus, the second groove 56 is disposed further rearward than the scanner unit 16.

The second groove 56 includes a large width portion 57 and a small width portion 58 which are integrally formed.

The large width portion 57 extends so as to be inclined rearward downward from the rear part at the lower edge of the first groove 47. A width of the large width portion 57 is reduced toward the rear lower side.

The small width portion 58 is connected to the lower end of the large width portion 57 and extends toward the rear lower side. The small width portion 58 has a substantially arc shape with a center at a rotation shaft 78 (described later) when viewed from the left-right direction. A width of the small width portion 58 is approximately the same as an outer diameter of an end of a drum shaft 131 (described later) in the left-right direction.

The rear wall 51 is disposed at a rear end of the main body casing 2. The rear wall 51 has a substantially rectangular shape extending in the left-right direction when viewed from the rear side. Each of both left and right ends of the rear wall 51 is connected to the rear end of the rear part 63 of each side wall 50.

The front wall 52 is disposed at a front end of the main body casing 2. The front wall 52 has a substantially crank shape in a side view and extending in the left-right direction. Each of both left and right ends of the front wall 52 is connected to the front end of the front part 64 of each side wall 50. The front wall 52 includes a cassette opening 60 and a sheet opening 61. The front wall 52 includes a lower portion 152, a stepped portion 153, and an upper portion 154 which are integrally formed.

The lower portion 152 is a lower part of the front wall 52. The lower portion 152 is a substantially plate shape extending in the upper-lower direction in a side view, and includes a cassette opening 60. The front wall 52 includes a cassette opening 60 and a sheet opening 61.

The cassette opening 60 is disposed at a lower end of the lower portion 152. The cassette opening 60 has a shape and a size which allow the sheet feed cassette 7 to pass through the cassette opening, and penetrates through the lower end of the lower portion 152 in the front-rear direction. The cassette opening 60 allows the sheet feed cassette 7 to pass therethrough when the sheet feed cassette 7 is mounted to or removed from the main body casing 2.

The stepped portion 153 has a plate shape extending in the front-rear direction in a side view, and is bent from an upper end of the lower portion 152 and extends rearward.

The upper portion 154 is an upper part of the front wall 52 and is located further rearward than the lower portion 152. The upper portion 154 has a substantially plate shape extending in the upper-lower direction in a side view, and is bent from a rear end of the stepped portion 153 and extends upward. The upper portion 154 has a sheet opening 61.

The sheet opening 61 is disposed at a lower end of the upper portion 154. The sheet opening 61 is disposed on the upper side of the cassette opening 60 with an interval therebetween at the front wall 52. The sheet opening 61 has a shape and a size which allow the sheet P to pass through the sheet opening 61, and penetrates through a substantially vertical center part of the front wall 52 in the front-rear direction. Although described later in detail, the sheet opening 61 receives the sheet P which is supplied from outside of the main body casing 2.

The bottom wall 53 is disposed at the lower end of the main body casing 2. The bottom wall 53 has a substantially rectangular plate shape in a bottom view. Each of both left and right ends of the bottom wall 53 is connected to the lower end of each side wall 50, and a rear end of the bottom wall 53 is connected to a lower end of the rear wall 51.

The top wall 54 is disposed at an upper end of the main body casing 2. The top wall 54 includes a flat bed support wall 65, a tray wall 66, and a sheet discharge wall 155.

The flat bed support wall 65 is disposed on the upper side of the sheet discharge section 5. The flat bed support wall 65 is connected to the upper end of the rear wall 51, and extends forward and in the left-right direction. Both left and right ends of the flat bed support wall 65 are connected to the upper end of the rear part 63 of each side wall 50. Further, the flat bed support wall 65 is in contact with a rear part of the flat bed scanner 40 from the lower side so as to support the flat bed scanner 40. Further, a connecting part of the flat bed support wall 65 and the rear wall 51 rotatably supports the shaft portion 44 of the flat bed scanner 40.

The tray wall 66 is bent from a front end of the flat bed support wall 65, and extends downward and in the left-right direction. Both left and right ends of the tray wall 66 are connected to the upper part at the front end of the rear part 63 of each side wall 50. The tray wall 66 includes a sheet discharge port 68.

The sheet discharge port 68 is disposed at an upper end of the tray wall 66, and is disposed on the front side of the pair of sheet discharge rollers 34. The sheet discharge port 68 has a shape and a size which allow the sheet P to pass through the sheet discharge port 68, and penetrates through the upper end of the tray wall 66 in the front-rear direction.

The sheet discharge wall 155 is disposed on the front side with respect to the tray wall 66 with an interval therebetween, and is disposed on the front upper side with respect to the scanner unit 16. The sheet discharge wall 155 is disposed so as to overlap the front end of the scanner unit 16, a transport roller 192 (described later), a sheet feed roller 193 (described later), and a pad 194 (described later), when projected in the upper-lower direction.

The sheet discharge wall 155 is connected to the upper end of the front wall 52, and extends toward the rear upper side and in the left-right direction. Both left and right ends of the sheet discharge wall 155 are connected to upper ends of the front parts 64 of the respective side walls 50. The sheet discharge wall 155 includes a sheet discharge wall body 157 and a bent portion 158 which are integrally formed.

The sheet discharge wall body 157 is connected to the upper end of the front wall 52, and extends so as to be inclined upward rearward. The sheet discharge wall body 157 is provided with a regulation receiving groove 156 and a sheet regulation portion 159.

The regulation receiving groove 156 is disposed at a substantially center part of the sheet discharge wall body 157 in the front-rear direction and the left-right direction.

The sheet regulation portion 159 is a substantially rectangular plate shape in a plan view. The sheet regulation portion 159 is moved between an inclined position where the sheet regulation portion 159 is accommodated in the regulation receiving groove 156 and is disposed along the sheet discharge wall body 157, and a standing position where the sheet regulation portion 159 is rotated in the clockwise direction in a left side view with a front end thereof as a fulcrum and stands up so as to extend toward the front upper side from the sheet discharge wall body 157. In a state where a movable tray 171 (described later) is located at a first position, the sheet regulation portion 159 is moved between the inclined position and the standing position via a base portion opening 184 and an extension portion opening 185.

The bent portion 158 is disposed at a rear end of the sheet discharge wall 155. The bent portion 158, which has a substantially crank shape in a side view, protrudes downward from the rear end of the sheet discharge wall body 157, is then bent rearward, and is subsequently bent downward.

That is, an engagement portion 160 is defined by the rear end of the sheet discharge wall body 157 and the bent part of the bent portion 158.

The engagement portion 160 is recessed in a substantially rectangular shape in a side view from the rear upper side toward the front lower side over the sheet discharge wall 155 in the left-right direction.

The main body casing 2 includes a scanner unit accommodation portion 163.

The scanner unit accommodation portion 163 has a substantially box shape which is opened rearward, and accommodates the scanner unit 16 in an inner space thereof. The scanner unit accommodation portion 163 includes an accommodation portion front wall 164, an accommodation portion top wall 165, and an accommodation portion bottom wall 166.

The accommodation portion front wall 164 is disposed at a front end of the scanner unit accommodation portion 163. The accommodation portion front wall 164 has a substantially rectangular plate shape extending in the left-right direction in a front view. Both left and right ends of the accommodation portion front wall 164 are connected to inner surfaces in the left-right direction of the front parts 64 of the respective side walls 50.

The accommodation portion top wall 165 is disposed at the upper end of the scanner unit accommodation portion 163. The accommodation portion top wall 165 has a substantially plate shape extending in a direction which connects the front upper side and the rear lower side. The accommodation portion top wall 165 includes an inclined wall 167, a guide wall 168, and a regulation wall 169.

The inclined wall 167 is connected to the upper end of the accommodation portion front wall 164, extends so as to be inclined upward rearward, is then bent, and extends so as to be inclined downward rearward.

The guide wall 168 is bent from a rear end of the inclined wall 167 so that a downward inclination thereof is larger than that of the inclined wall 167, and extends so as to be inclined downward rearward.

The regulation wall 169 is bent from a rear end of the guide wall 168 so that a downward inclination thereof is larger than that of the guide wall 168, is inclined downward rearward, and is further bent so as to protrude downward.

The accommodation portion top wall 165 includes cutout portions 73 at respective ends thereof in the left-right direction.

The cutout portions 73 are respectively disposed at the left and right ends of the accommodation portion top wall 165, so as to correspond to a cover guide 80 (described later). The cutout portions 73 are cut out in a substantially rectangular shape in a plan view from ends of the regulation wall 169 in the left-right direction up to an approximately center of the inclined wall 167 in the front-rear direction. Thus, the cutout portions 73 communicate with the front end of the first groove 47 of the main body casing 2 in the upper-lower direction.

The accommodation portion bottom wall 166 is disposed at a lower end of the scanner unit accommodation portion 163. The accommodation portion bottom wall 166 has a substantially rectangular plate shape extending in the left-right direction in a bottom view. A front end of the accommodation portion bottom wall 166 is connected to the lower end of the accommodation portion front wall 164, and both left and right ends of the accommodation portion bottom wall 166 are connected to the inner surfaces in the left-right direction of the front parts 64 of the respective side walls 50.

As shown in FIG. 1, a process opening 75 is defined by the regulation wall 169, the lower end of the tray wall 66, and the upper end of the front part 64 of each side wall 50 located between the regulation wall 169 and the tray wall 66. That is, the main body casing 2 has the process opening 75.

The process opening 75 has a substantially rectangular shape in a plan view, and allows the inner space of the main body casing 2 to communicate with the outside of the main body casing 2 in the upper-lower direction. The process opening 75 has a size which allows the process cartridge 15 to pass through the process opening 75.

Further, the main body casing 2 includes a top cover 77 for opening and closing the process opening 75.

The top cover 77 includes a rotation shaft 78, a cover body 79, and a cover guide 80.

The rotation shaft 78 has a substantially columnar shape extending in the left-right direction, and is rotatably supported at the lower end of the tray wall 66, that is, at a rear edge of the process opening 75.

The cover body 79 has a plate shape, and extends outward in the radial direction of the rotation shaft 78 from the rotation shaft 78. The cover body 79 includes a reception portion 162.

The reception portion 162 is disposed at a front end of the upper surface of the cover body 79. The reception portion 162 is recessed in a substantially rectangular shape in a side view from the upper surface of the cover body 79 toward the rear lower side, and is opened toward the front lower side.

The cover guide 80 is disposed at each of both left and right ends in a front part of a lower surface of the cover body 79. Herein, when the left cover guide 80 and the right cover guide 80 are differentiated from each other, the left cover guide 80 is indicated by a left cover guide 80L, and the right cover guide 80 is indicated by a right cover guide 80R.

Figure 4:
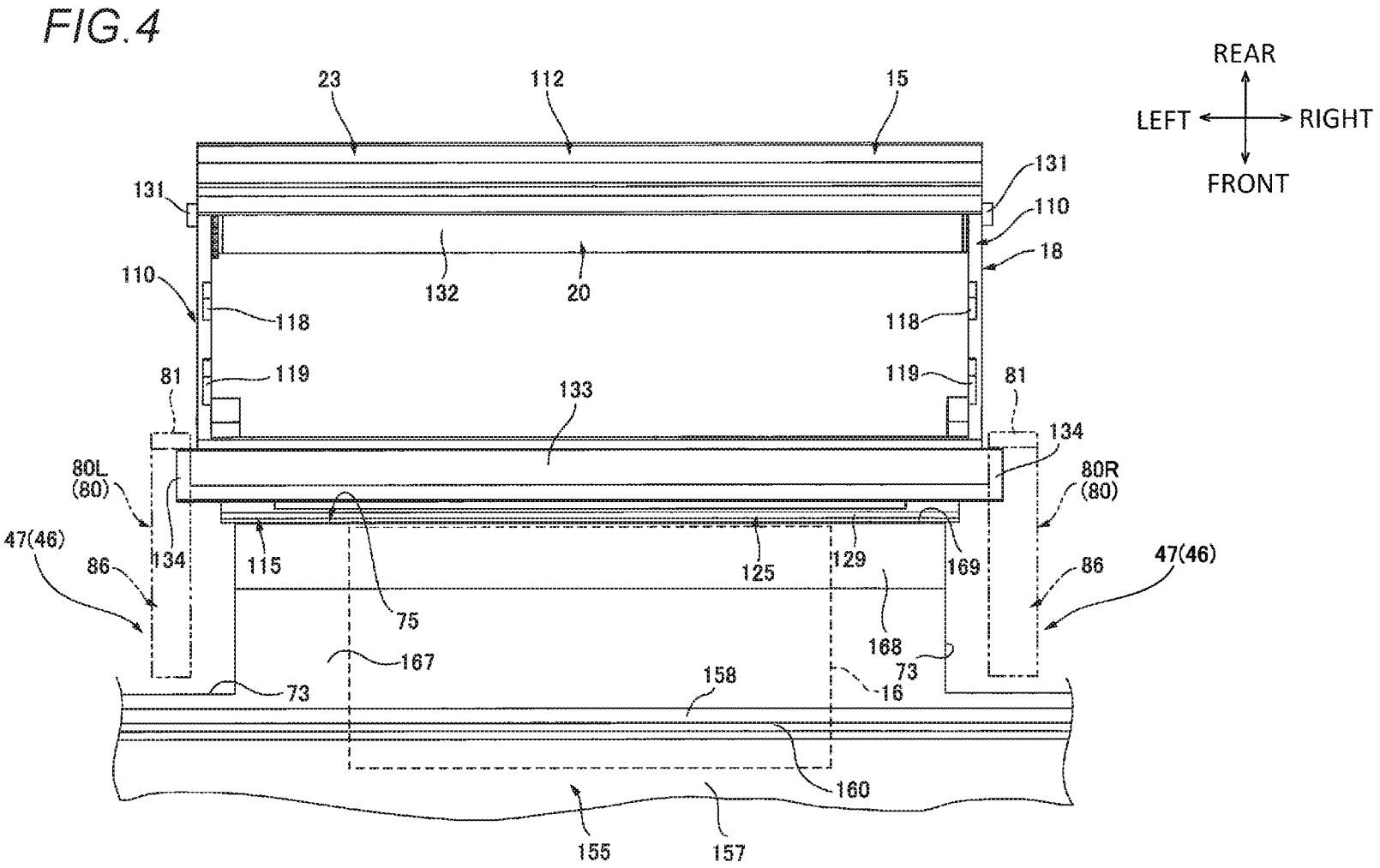
FIG. 4 is a plan view of the printer shown in FIG. 1, and shows a state where a cover body and a movable tray are removed.

The cover guide 80 has a substantially L shape in a side view. A dimension of the cover guide 80 in the left-right direction is smaller than a dimension of the cutout portion 73 in the left-right direction as shown in FIG. 4. Further, the cover guide 80 includes a regulation portion 81 and a guide body 86 which are integrally formed as shown in FIG. 1.

The regulation portion 81 is connected to an approximately center part in the front-rear direction at an end of the cover body 79 in the left-right direction and extends toward the front lower side.

The guide body 86 is connected to a lower end of the regulation portion 81 and extends forward. Thus, the guide body 86 is substantially parallel to the cover body 79, and extends so as to be separated from the rotation shaft 78. Specifically, the guide body 86 includes an engagement portion 82, a first cover guide 83, a second cover guide 84, and an introduction portion 85 which are integrally formed.

The engagement portion 82 is connected to the lower end of the regulation portion 81 and extends toward the front lower side, and is then bent so as to extend toward the front upper side.

The first cover guide 83 is bent from a front end of the engagement portion 82 so that a forward inclination is larger than that of a front part of the engagement portion 82, and extends so as to be inclined slightly upward forward.

The second cover guide 84 is bent from a front end of the first cover guide 83, and extends so as to be inclined slightly downward forward.

The introduction portion 85 is bent from a front end of the second cover guide 84, and extends so as to be further inclined slightly downward forward than the second cover guide 84.

Figure 2:
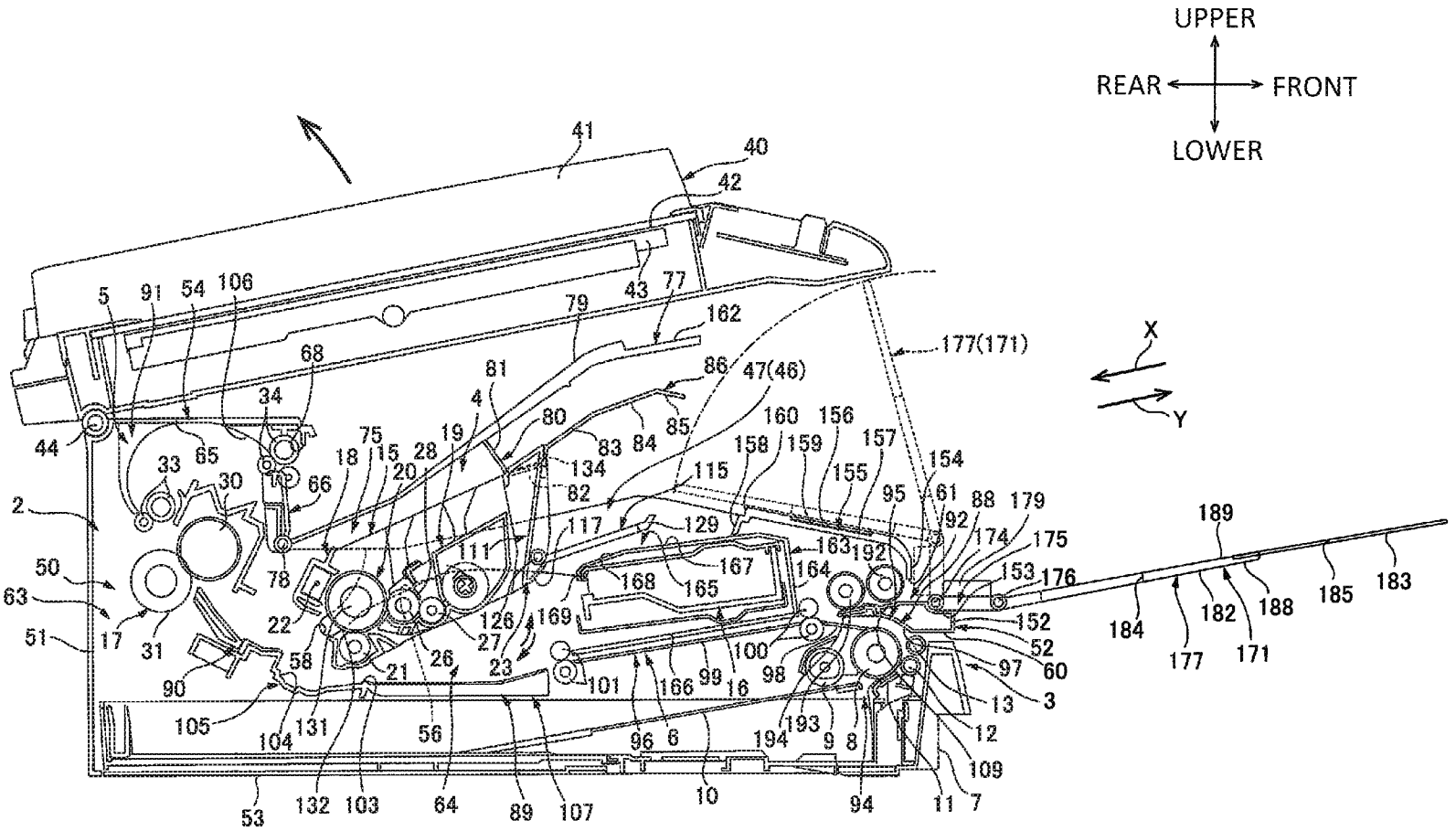
FIG. 2 is a center cross-sectional view of the printer shown in FIG. 1, and shows a state where the process cartridge is located at an extraction position.

The top cover 77 can swing between a closed position where the process opening 75 is closed and an open position where the process opening 75 is opened with the rotation shaft 78 as a fulcrum as shown in FIG. 2.

As shown in FIG. 1, in a state where the top cover 77 is located at the closed position, the cover body 79 is disposed so as to extend forward from the rotation shaft 78, and a front end of the cover body 79 is engaged to the engagement portion 160. In a state where the top cover 77 is located at the closed position, the front surface of the tray wall 66, the upper surface of the cover body 79, and the upper surface of the sheet discharge wall 155 configure the sheet discharge tray 35.

In each of both left and right cover guides 80, the front portion of the guide body 86 is disposed in the first groove 47 of the groove 46 via the cutout portion 73 in a state where the top cover 77 is located at the closed position as shown in FIG. 4. Thus, the left cover guide 80L is disposed on the left with respect to the scanner unit 16 with an interval therebetween, and the right cover guide 80R is disposed on the right side with respect to the scanner unit 16 with an interval therebetween. The introduction portion 85 of the guide body 86 overlaps the scanner unit 16 when projected in the left-right direction as shown in FIG. 1.

On the other hand, as shown in FIG. 2, in a state where the top cover 77 is located at the open position, the cover body 79 is disposed in a direction which connects the front upper side and the rear lower side, and the front end of the cover body 79 is disposed on the upper side with respect to the regulation wall 169 with an interval therebetween through which the process cartridge 15 can pass.

The first cover guide 83 of the cover guide 80 is disposed so as to be substantially parallel to the guide wall 168 of the accommodation portion top wall 165, and the second cover guide 84 is disposed so as to be substantially parallel to the inclined wall 167 of the accommodation portion top wall 165.

3. Details of Sheet Guide Section

The sheet guide section 6 is disposed in the main body casing 2 as shown in FIG. 1. The sheet guide section 6 includes a first sheet guide 88, a second sheet guide 89, a third sheet guide 90, a fourth sheet guide 91, and a fifth sheet guide 92.

The first sheet guide 88 is a part which is located on the lower side of the scanner unit 16 in the sheet guide section 6, and guides transport of the sheet P which is directed from the sheet feed cassette 7 toward the sheet feed roller 8 and is returned toward the rear upper side. The first sheet guide 88 includes an upstream part 94, a middle part 95, and a downstream part 96.

The upstream part 94 is an upstream part in a transport direction of the sheet P in the first sheet guide 88, and guides transport of the sheet P accommodated in the sheet feed cassette 7, which is directed toward the sheet feed roller 8. The upstream part 94 includes a pickup roller 9, the sheet lift 10, and the sheet feed pad 11.

The pickup roller 9 has a substantially columnar shape extending in the left-right direction, and is disposed on the rear side of the sheet feed roller 8 with an interval therebetween.

The sheet lift 10 has a substantially rectangular plate shape in a plan view, and is disposed at a front part in the sheet feed cassette 7. A front part of the sheet P accommodated in the sheet feed cassette 7 is placed on an upper surface of the sheet lift 10.

The sheet lift 10 can swing with its rear end as a fulcrum, and is biased in a counterclockwise direction in a left side view at all times by a spring member (not shown). That is, a front end of the sheet lift 10 is biased toward the pickup roller 9 by the spring member (not shown). Therefore, the front end of the sheet P placed on the upper surface of the sheet lift 10 is interposed between the front end of the sheet lift 10 and the pickup roller 9.

The sheet feed pad 11 is disposed on the front lower side of the pickup roller 9, and is also disposed on the front lower side of the sheet feed roller 8. The sheet feed pad 11 has a plate shape, and extends in a direction which connects the front upper side to the rear lower side in a side view. An upper surface of the sheet feed pad 11 is in contact with a front lower end of the sheet feed roller 8.

The middle part 95 is a part which is disposed between the upstream part 94 and the downstream part 96 in the first sheet guide 88, and guides transport of the sheet P which is returned by the sheet feed roller 8. The middle part 95 includes a first pinch roller 12, a second pinch roller 13, a curved guide 97, and a linear guide 98.

The first pinch roller 12 is disposed on the front upper side with respect to the sheet feed pad 11, and is also disposed on the front side of the sheet feed roller 8. The first pinch roller 12 has a substantially columnar shape extending in the left-right direction, and a rear end of the first pinch roller 12 is in contact with the front end of the sheet feed roller 8.

The second pinch roller 13 is disposed on the front upper side of the first pinch roller 12, and is also disposed on the front side of the sheet feed roller 8 with an interval therebetween. The second pinch roller 13 has a substantially columnar shape extending in the left-right direction.

The curved guide 97 is disposed on the rear upper side of the second pinch roller 13, and is disposed on the upper side with respect to the upper end of the sheet feed roller 8 with an interval therebetween. The curved guide 97 has a plate shape extending in the front-rear direction, and is curved toward the front upper side in a side view.

The linear guide 98 is disposed on the rear lower side of the curved guide 97 with an interval therebetween, and is disposed to be adjacent to the upper end of the sheet feed roller 8 on the rear side. The linear guide 98 has a plate shape extending in the front-rear direction.

The downstream part 96 is a downstream part in the transport direction of the sheet P in the first sheet guide 88, and guides transport of the sheet P which is directed from the sheet feed roller 8 to the second sheet guide 89. The downstream part 96 includes a pair of first transport rollers 100, a pair of second transport rollers 101, and an inclined guide 99.

The pair of first transport rollers 100 are disposed to be adjacent to the rear end of the linear guide 98 on the rear side, and is also disposed on the front side of the scanner unit 16. The pair of first transport rollers 100 are disposed further rearward than the sheet feed roller 8. Each of the pair of first transport rollers 100 has a substantially columnar shape extending in the left-right direction, and the first transport rollers 100 are in contact with each other in the upper-lower direction.

The pair of second transport rollers 101 are disposed on the rear lower side with respect to the pair of first transport rollers 100 with an interval therebetween, and is disposed further rearward than the scanner unit 16. Each of the pair of second transport rollers 101 has a substantially columnar shape extending in the left-right direction, and the second transport rollers 101 are in contact with each other in the upper-lower direction.

The inclined guide 99 is disposed between the pair of first transport rollers 100 and the pair of second transport rollers 101. The inclined guide 99 is disposed on the lower side so as to be substantially parallel to the accommodation portion bottom wall 166 of the scanner unit accommodation portion 163 with an interval therebetween. Specifically, the inclined guide 99 is inclined lowered as proceeding toward downstream in the transport direction of the sheet P at the downstream part 96. The inclined guide 99 has a plate shape extending in a direction which connects the front upper side to the rear lower side, and is disposed with respect to the accommodation portion bottom wall 166 with an interval therebetween in a direction which connects the front lower side and the rear upper side so as to allow the sheet P to pass therethrough. That is, the accommodation portion bottom wall 166 configures the downstream part 96 of the first sheet guide 88 along with the pair of first transport rollers 100, the pair of second transport rollers 101, and the inclined guide 99.

As mentioned above, in the first sheet guide 88, the upstream part 94 and the middle part 95 are disposed further forward than the scanner unit 16. On the other hand, the downstream part 96 of the first sheet guide 88 is disposed on the lower side with respect to the scanner unit 16 so as to overlap the scanner unit 16 when projected in the upper-lower direction.

The second sheet guide 89 is a part which is disposed on the lower side of the process cartridge 15 in the sheet guide section 6, and includes a guide part 107 and a reception part 105 which are integrally formed.

The guide part 107 is disposed on the lower side of the developing cartridge 19, and guides transport of the sheet P which is directed from the first sheet guide 88 toward the contact point N between the photosensitive drum 20 and the transfer roller 21 along a sheet feed path 135 (described later).

The guide part 107 is disposed to be adjacent to the pair of second transport rollers 101 on the rear side so as to be connected to a downstream end of the first sheet guide 88 in the transport direction. The second sheet guide 89 extends in the front-rear direction in a side view. The second sheet guide 89 includes a guide protrusion 103.

The guide protrusion 103 is disposed at a rear end of an upper surface of the guide part 107, that is, a downstream end of the guide part 107 in the transport direction of the sheet P. The guide protrusion 103 corresponds to the sheet feed path 135 (described later), and is disposed on the front lower side of the sheet feed path 135. The guide protrusion 103 has a substantially rectangular shape in a side view, and protrudes upward from the upper surface of the guide part 107.

The reception part 105 is disposed on the lower side of a transfer accommodation wall 113 (described later), and is disposed to be adjacent to the guide part 107 on the rear side. The reception part 105 is connected to the rear end of the guide part 107 and extends rearward. Further, the reception part 105 includes a recess portion 104.

The recess portion 104 is recessed from an upper surface of the reception part 105 toward the rear lower side. The recess portion 104 has a substantially curved shape in a side view, and is disposed along the rear end of the process cartridge 15, specifically, a rear end of a roller accommodation portion 122 (described later).

The third sheet guide 90 is a part which is disposed between the process cartridge 15 and the fixing unit 17 in the sheet guide section 6, and guides transport of the sheet P which passes through the contact point N between the photosensitive drum 20 and the transfer roller 21 and is then directed toward the fixing unit 17. The third sheet guide 90 is connected to the rear end of the reception part 105, and extends toward the rear upper side so as to be directed toward the fixing unit 17.

The fourth sheet guide 91 is a part which is disposed between the pair of guide rollers 33 and the pair of sheet discharge rollers 34 in the sheet guide section 6, and guides transport of the sheet P which passes through the pair of guide rollers 33 and is then returned to the pair of sheet discharge rollers 34. The fourth sheet guide 91 is disposed on the lower side of the flat bed support wall 65, and protrudes downward from the front part of the lower surface of the flat bed support wall 65. The fourth sheet guide 91 includes a concave portion 106.

The concave portion 106 has a substantially U shape which is opened toward the front lower side in a side view, and is recessed toward the rear upper side from the lower end of the fourth sheet guide 91. A rear end of the concave portion 106 is disposed on the upper side of the pair of guide rollers 33, and a front end of the concave portion 106 is disposed on the rear side of the pair of sheet discharge rollers 34.

The fifth sheet guide 92 is disposed on the upper side of the middle part 95 of the first sheet guide 88 and on the front side of the scanner unit 16, at the front end of the main body casing 2. The fifth sheet guide 92 guides transport of the sheet P which is supplied from outside of the main body casing 2 via the sheet opening 61 and is directed toward the pair of first transport rollers 100. The fifth sheet guide 92 includes a transport roller 192, a sheet feed roller 193, an upper plate 108, a lower plate 109 and a pad 194.

The transport roller 192 has a substantially columnar shape extending in the left-right direction, and is disposed on the rear side with respect to the sheet opening 61.

The sheet feed roller 193 has a substantially columnar shape extending in the left-right direction, and is disposed on the rear side with respect to the transport roller 192.

The lower plate 109 extends rearward from a lower edge of the sheet opening 61 of the front wall 52 in a side view. The lower plate 109 is disposed on the lower side with respect to the transport roller 192 and the sheet feed roller 193 with an interval therebetween.

The rear end of the lower plate 109 is connected to the rear end of the curved guide 97. Thus, the fifth sheet guide 92 and the middle part 95 of the first sheet guide 88 are connected to each other on the front side of the pair of first transport rollers 100.

The pad 194 is disposed on the lower side of the sheet feed roller 193, and is supported at a rear end of the upper surface of the lower plate 109. The pad 194 has a plate shape, and extends in a direction which connects the front upper side and the rear lower side in a side view. The upper surface of the pad 194 is in contact with a lower end of the sheet feed roller 193.

4. Details of Process Cartridge

The process cartridge 15 includes the drum cartridge 18 and the developing cartridge 19 as described above.

(1) Drum Cartridge

Figure 5:
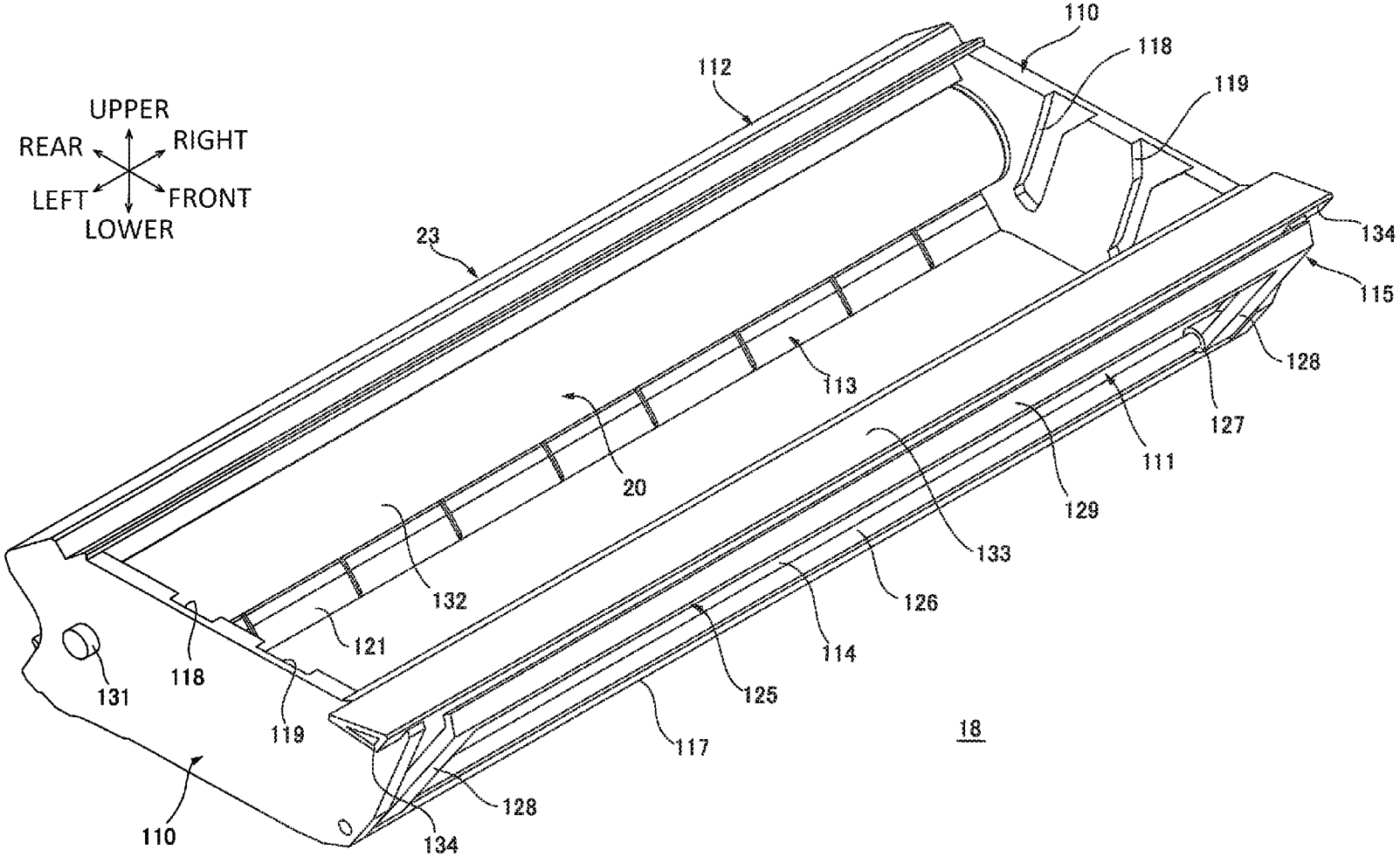
FIG. 5 is a perspective view in which a drum cartridge shown in FIG. 4 is viewed from an upper left side.

The drum cartridge 18 includes a drum frame 23 as shown in FIG. 5. The drum frame 23 has a substantially rectangular frame shape extending in the left-right direction, and includes a pair of drum side walls 110, a drum front wall 111, a charger holding wall 112, and a transfer accommodation wall 113 which are integrally formed.

The pair of drum side walls 110 are respectively disposed at both left and right ends of the drum frame 23, and are disposed with an interval therebetween in the left-right direction. Each of the pair of drum side walls 110 has a substantially rectangular plate shape extending in the front-rear direction in a side view. Each of the pair of drum side walls 110 includes a first roller reception groove 118, a second roller reception groove 119, and a protrusion 134.

The first roller reception groove 118 and the second roller reception groove 119 are disposed on an inner surface of each of the drum side walls 110 in the left-right direction.

Figure 6:
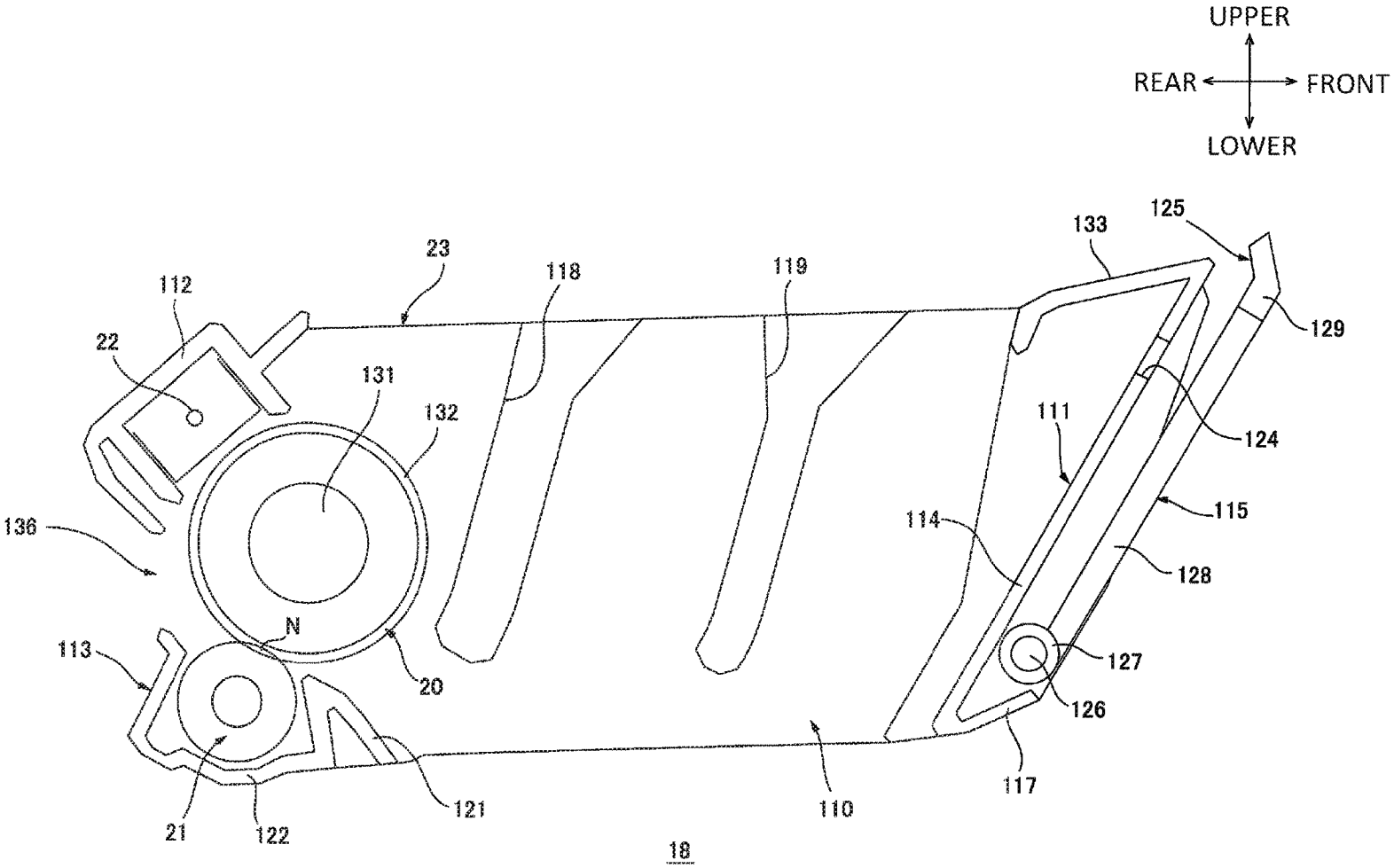
FIG. 6 is a center cross-sectional view of the drum cartridge shown in FIG. 5.

The first roller reception groove 118, as shown in FIG. 6, corresponds to a first roller 147 (described later), and is disposed at a rear part of the inner surface of the drum side wall 110 in the left-right direction. The first roller reception groove 118 is recessed outward in the left-right direction on the inner surface of the drum side wall 110 in the left-right direction, and extends so as to be inclined rearward downward from an upper edge of the drum side wall 110.

The second roller reception groove 119 corresponds to a second roller 150 (described later), and is disposed on the front side of the first roller reception groove 118 with an interval therebetween on the inner surface of the drum side wall 110 in the left-right direction. The second roller reception groove 119 is recessed outward in the left-right direction on the inner surface of the drum side wall 110 in the left-right direction, and extends so as to be inclined rearward downward from an upper edge of the drum side wall 110.

The protrusions 134 are respectively disposed on outer surfaces of the pair of drum side walls 110 in the left-right direction so as to correspond to the two cover guides 80, as shown in FIG. 5. The protrusion 134 has a substantially triangular shape in a side view, and protrudes outward in the left-right direction from a front upper end of the outer surface of each drum side wall 110 in the left-right direction.

A front edge and a lower edge of the protrusion 134 have substantially the same as the shape of the engagement portion 82 of the cover guide 80 in a side view. Specifically, the upper edge of the protrusion 134 extends substantially in the front-rear direction; the front edge of the protrusion 134 extends from a front end of the upper edge of the protrusion 134 toward the rear lower side; and the lower edge of the protrusion 134 extends from a lower end of the front edge of the protrusion 134 toward the rear upper side and is connected to a rear end of the upper edge of the protrusion 134.

The drum front wall 111 is disposed at the front end of the drum frame 23 as shown in FIG. 6. The drum front wall 111 has a substantially Z shape in a side view, and extends in the left-right direction. Each of both left and right ends of the drum front wall 111 is connected to the front end of each drum side wall 110.

The drum front wall 111 includes a front wall body 114, a handle portion 133, and a contact portion 117 which are integrally formed.

The front wall body 114 has a plate shape extending in a direction which connects the front upper side to the rear lower side, and extends in the left-right direction. Each of both left and right ends of the front wall body 114 is connected to a part which is located slightly further rearward than the front edge of each drum side wall 110. Thus, the front end of each drum side wall 110 is located further forward than the front wall body 114. The front wall body 114 includes a laser passing hole 124.

The laser passing hole 124 is disposed on an upper part of the front wall body 114 so as to correspond to a light path of the laser beam L. The laser passing hole 124 has a shape and a size which allow the laser beam L to pass through the laser passing hole 124, and penetrates through the front wall body 114 in the front-rear direction.

The handle portion 133 has a plate shape extending from the upper end of the drum front wall 111 toward the rear lower side, and extends in the left-right direction as shown in FIG. 5. An upper surface of the handle portion 133 is substantially same level as an upper surface of each protrusion 134.

The contact portion 117 has a plate shape which extends from the lower end of the drum front wall 111 toward the front upper side as shown in FIG. 6.

The charger holding wall 112 is disposed at a rear upper end of the drum frame 23. The charger holding wall 112 has a substantially U shape which is opened toward the front lower side in a side view, and extends in the left-right direction. Each of both left and right ends of the charger holding wall 112 is connected to the rear upper end of each drum side wall 110.

The transfer accommodation wall 113 is disposed at the rear lower end of the drum frame 23, and is disposed on the lower side with respect to the charger holding wall 112 with an interval therebetween. The transfer accommodation wall 113 extends in the left-right direction, and is connected to the rear lower end of each drum side wall 110. The transfer accommodation wall 113 includes a roller accommodation portion 122 and a lip portion 121 which are integrally formed.

The roller accommodation portion 122 is a rear part of the transfer accommodation wall 113, and has a substantially U shape which is opened upward in a side view. The lip portion 121 is a front part of the transfer accommodation wall 113, and extends so as to be inclined downward forward from an upper end of a front wall of the roller accommodation portion 122.

An opening region between an upper end of a rear wall of the roller accommodation portion 122 and a lower end of a rear wall of the charger holding wall 112 is defined as a sheet discharge opening 136 for discharging the sheet P which has passed through the contact point N between the photosensitive drum 20 and the transfer roller 21.

The drum cartridge 18 includes the photosensitive drum 20, the transfer roller 21, the scorotron charger 22, and a handle 115.

The photosensitive drum 20 is disposed between the rear ends of the pair of drum side walls 110, and is disposed on the front lower side of the charger holding wall 112 and an upper side of the transfer accommodation wall 113. The photosensitive drum 20 includes a drum body 132 and a drum shaft 131.

The drum body 132 includes a cylindrical portion which has a substantially cylindrical shape extending in the left-right direction and is made of a metal, and a photosensitive layer which is coated over a circumferential surface of the cylindrical portion.

The drum shaft 131 has a substantially columnar shape extending in the left-right direction. A dimension of the drum shaft 131 in the left-right direction is larger than a dimension of the drum body 132 in the left-right direction, and is also larger than a dimension of the drum frame 23 in the left-right direction. The drum shaft 131 is disposed inside the drum body 132 so that a center axis line thereof matches a center axis line of the drum body 132.

Further, the photosensitive drum 20 is rotatably supported at the drum frame 23 while both left and right ends of the drum shaft 131 are supported at the respective drum side walls 110. Each of both left and right ends of the drum shaft 131 protrudes outward in the left-right direction from the drum side wall 110 as shown in FIG. 5.

The transfer roller 21 is disposed inside the roller accommodation portion 122 of the transfer accommodation wall 113 as shown in FIG. 6. The transfer roller 21 has a substantially columnar shape extending in the left-right direction. The transfer roller 21 is rotatably supported at the drum frame 23 while both left and right ends thereof are supported at the respective drum side walls 110. The front upper end of the transfer roller 21 is in contact with the rear lower end of the drum body 132 of the photosensitive drum 20.

The scorotron charger 22 is supported at the charger holding wall 112 inside the charger holding wall 112. Thus, the scorotron charger 22 is disposed with respect to the photosensitive drum 20 on the rear upper side of the photosensitive drum 20 with a slight gap therebetween.

The handle 115 is disposed at the front end of the drum cartridge 18, and is disposed on the front side with respect to the drum front wall 111. Although described later in detail, the handle 115 swings between an accommodation position where the handle 115 stands up along the drum front wall 111 as shown in FIGS. 1 and 4 to 6, and an ejection position where a grip portion 129 (described later) is inclined so as to be separated forward from the drum front wall 111 as shown in FIGS. 2 and 3. Further, the following description will be made with a state where the handle 115 is located at the accommodation position shown in FIGS. 1 and 4 to 6 as a reference.

As shown in FIG. 5, the handle 115 includes a handle body 125 and a swing shaft 126.

The handle body 125 has a substantially U shape which is opened downward in a front view, and includes a pair of cylindrical portions 127, a pair of connection portions 128, and a grip portion 129 which are integrally formed.

The pair of cylindrical portions 127 are disposed with an interval therebetween in the left-right direction. Each of the pair of cylindrical portions 127 has a substantially cylindrical shape extending in the left-right direction. An inner diameter of the cylindrical portion 127 is slightly larger than an outer diameter of the swing shaft 126. Each of the pair of connection portions 128 corresponds to each cylindrical portion 127 as shown in FIG. 6, is connected to the corresponding cylindrical portion 127, and has a substantially rod shape extending toward the front upper side. The grip portion 129 is disposed between upper ends of the pair of connection portions 128. The grip portion 129 has a substantially rod shape extending in the left-right direction, and both left and right ends thereof are connected to the upper ends of the respective connection portions 128.

The swing shaft 126 has a substantially columnar shape extending in the left-right direction. The swing shaft 126 is inserted into the pair of cylindrical portions 127 so as to be relatively rotatable.

The handle 115 is supported at the drum frame 23 while both left and right ends of the swing shaft 126 are supported at the front lower ends of the pair of drum side walls 110.

(2) Developing Cartridge

Figure 7B:
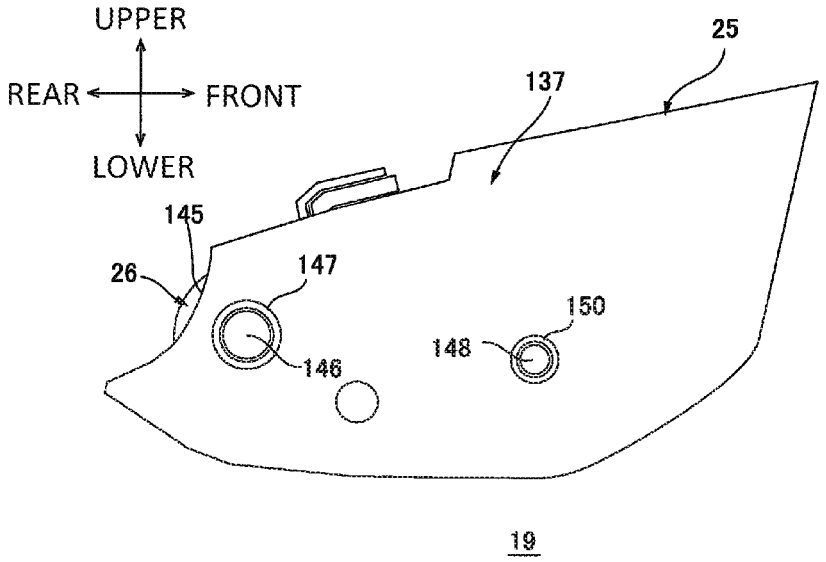
FIG. 7B is a left side view of the developing cartridge shown in FIG. 7A.

The developing cartridge 19 is removably mounted to the drum frame 23 as shown in FIGS. 5 and 7B.

The developing cartridge 19 includes, as shown in FIG. 7A, a developing frame 25, the developing roller 26, the supply roller 27, the layer thickness regulation blade 28, and an agitator 142.

The developing frame 25 includes a pair of developing side walls 137, a toner accommodation portion 139, a blade support portion 138, and a developing bottom wall 140 which are integrally formed.

The pair of developing side walls 137 are disposed at both left and right ends of the developing frame 25, and are disposed with an interval therebetween in the left-right direction. Each of the pair of developing side walls 137 has a substantially rectangular plate shape extending in the front-rear direction in a side view as shown in FIG. 7B.

The toner accommodation portion 139 is disposed between front parts of the pair of developing side walls 137 as shown in FIG. 7A. The toner accommodation portion 139 has a substantially square tubular shape extending in the left-right direction, and both left and right ends thereof are closed by the front part of each developing side wall 137. The toner accommodation portion 139 accommodates toner therein. The toner accommodation portion 139 includes a communication hole 141.

The communication hole 141 is disposed at a lower end of a rear wall of the toner accommodation portion 139, and penetrates through the rear wall of the toner accommodation portion 139 in the front-rear direction.

The blade support portion 138 is disposed at an upper end of a rear surface of a rear wall of the toner accommodation portion 139. The blade support portion 138 has a substantially rectangular shape which protrudes rearward from the rear surface of the rear wall of the toner accommodation portion 139 in a side view.

The developing bottom wall 140 extends rearward from a lower end of the rear wall of the toner accommodation portion 139. Both left and right ends of the developing bottom wall 140 are connected to lower ends of rear parts of the respective developing side walls 137. The developing bottom wall 140 includes a front part 143 and a rear part 144 which are integrally formed.

The front part 143 has a substantially semicircular shape which is opened upward in a side view, and an inner circumferential surface of the front part 143 is curved along an outer circumferential surface of the supply roller 27. A front end of the front part 143 is connected to a lower edge of the communication hole 141 of the rear wall of the toner accommodation portion 139. The rear part 144 extends toward the rear upper side so as to be curved along an outer circumferential surface of the developing roller 26 from a rear end of the front part 143.

The developing roller 26 is disposed on the front upper side of the rear part 144 of the developing bottom wall 140 with an interval therebetween. As shown in FIGS. 7A and 7B, the developing roller 26 includes a roller body 145, a developing roller shaft 146, and the first roller 147.

The roller body 145 is disposed between the rear ends of the pair of developing side walls 137, and has a substantially cylindrical shape extending in the left-right direction. A dimension of the roller body 145 in the left-right direction is slightly smaller than an interval between the pair of developing side walls 137 in the left-right direction.

The developing roller shaft 146 has a substantially columnar shape extending in the left-right direction. A dimension of the developing roller shaft 146 in the left-right direction is larger than a dimension of the developing frame 25 in the left-right direction. The developing roller shaft 146 is fitted in the roller body 145 so that each of both left and right ends protrudes further outward than the roller body 145 in the left-right direction. Both left and right ends of the developing roller shaft 146 are rotatably supported at the developing side walls 137. Thus, the developing roller 26 is rotatably supported at the developing frame 25. Further, each of both left and right ends of the developing roller shaft 146 protrudes outward in the left-right direction from the developing side wall 137.

Two first rollers 147 are provided so as to respectively correspond to both left and right ends of the developing roller shaft 146. Each first roller 147 is disposed outward in the left-right direction with respect to the developing side wall 137. The first roller 147 has a cylindrical shape extending in the left-right direction, and an inner diameter of the first roller 147 is substantially the same as an outer diameter of the developing roller shaft 146. The first roller 147 is fitted in a part which is an end of the developing roller shaft 146 in the left-right direction and is located further outward than the developing side wall 137 in the left-right direction.

The supply roller 27 is disposed inside the front part 143 of the developing bottom wall 140, and is disposed on the rear side of the communication hole 141 of the toner accommodation portion 139. A rear upper end of the supply roller 27 is in contact with a front lower end of the roller body 145. Further, the supply roller 27 is rotatably supported at the developing frame 25 while both left and right ends thereof are supported at the respective developing side walls 137.

The layer thickness regulation blade 28 is fixed to a rear surface of the blade support portion 138. A lower end of the layer thickness regulation blade 28 is in contact with a front end of the roller body 145.

The agitator 142 is disposed at a rear lower end inside the toner accommodation portion 139. The agitator 142 includes an agitator shaft 148, and an agitator blade 149.

The agitator shaft 148 has a substantially columnar shape extending in the left-right direction. A dimension of the agitator shaft 148 in the left-right direction is larger than a dimension of the developing frame 25 in the left-right direction. Both left and right ends of the agitator shaft 148 are rotatably supported at the respective developing side walls 137. Thus, the agitator 142 is rotatably supported at the developing frame 25. Further, each of both left and right ends of the agitator shaft 148 protrudes outward in the left-right direction from the developing side wall 137.

The agitator blade 149 is made of a flexible film material. The agitator blade 149 extends outward in the radial direction of the agitator shaft 148 from a part where the agitator shaft 148 is located inside the toner accommodation portion 139.

Two second rollers 150 are provided so as to respectively correspond to both left and right ends of the agitator shaft 148. Each second roller 150 is disposed outward in the left-right direction with respect to the developing side wall 137. The second roller 150 has a cylindrical shape extending in the left-right direction, and an inner diameter of the second roller 150 is substantially the same as an outer diameter of the agitator shaft 148. The second roller 150 is fitted in a part which is an end of the agitator shaft 148 in the left-right direction and is located further outward in the left-right direction than the developing side wall 137.

This developing cartridge 19 is mounted to the drum frame 23 shown in FIG. 5 from the upper side, for example, by an operator. Specifically, the developing cartridge 19 is mounted to the drum frame 23 so that each first roller 147 is inserted into the corresponding first roller reception groove 118 from the upper side, and each second roller 150 is inserted into the corresponding second roller reception groove 119 from the upper side.

Accordingly, the developing cartridge 19 is mounted to the drum frame 23, so as to configure the process cartridge 15.

In a state where the developing cartridge 19 is mounted to the drum frame 23, as shown in FIG. 1, the developing roller 26 is disposed on the front lower side of the photosensitive drum 20, and the rear upper end of the roller body 145 is in contact with the front lower end of the drum body 132. The rear part 144 of the developing bottom wall 140 is disposed on the front upper side with respect to the lip portion 121 of the transfer accommodation wall 113 with an interval therebetween. Thus, the rear part 144 of the developing bottom wall 140 and the lip portion 121 of the transfer accommodation wall 113 define the sheet feed path 135 for supplying the sheet P to the contact point N between the photosensitive drum 20 and the transfer roller 21.

5. Details of Movable Tray

Figure 8:
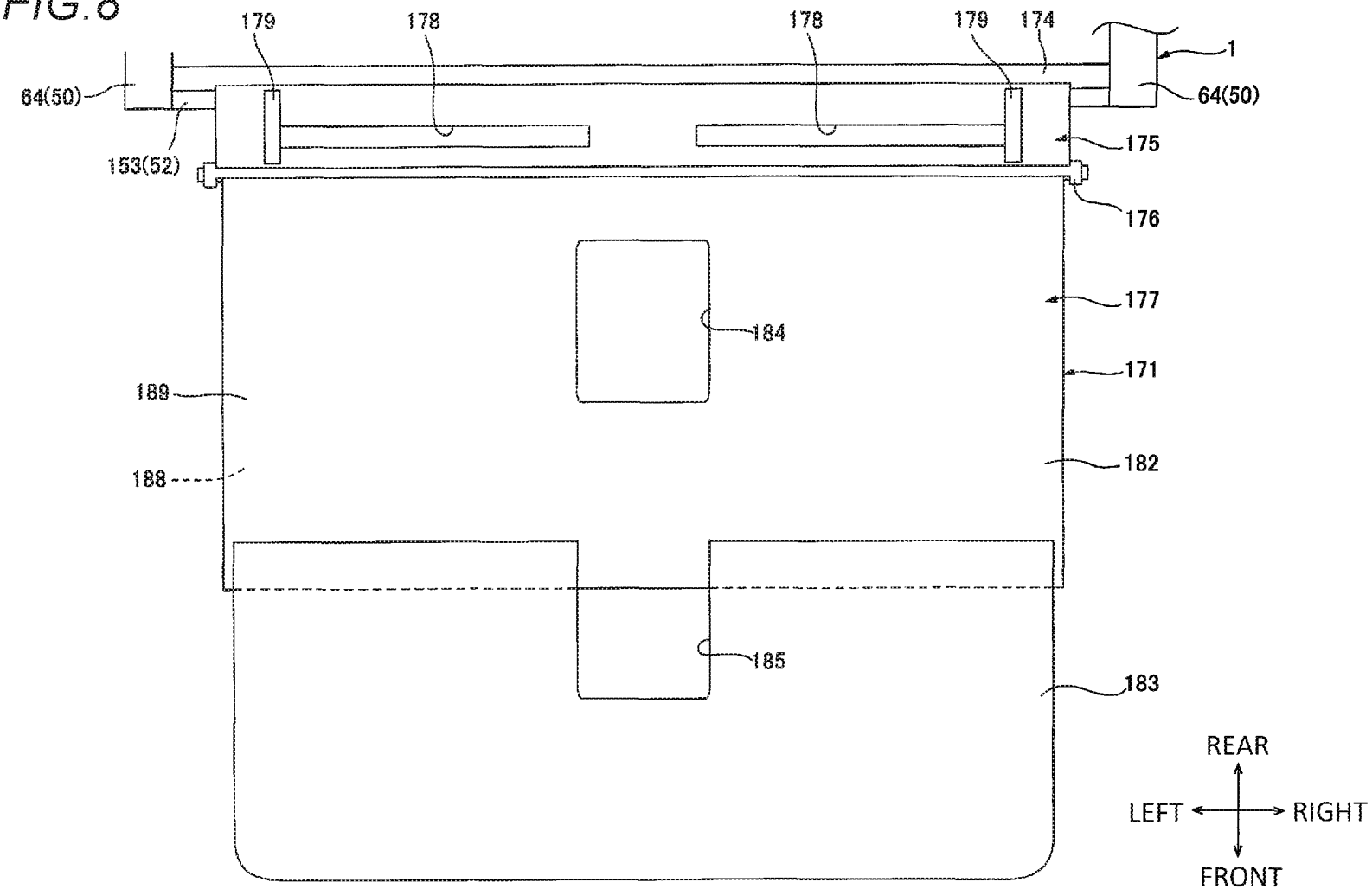
FIG. 8 is a plan view of the printer shown in FIG. 3, and shows a state where the movable tray is located at a second position.

The main body casing 2 includes the movable tray 171 as shown in FIGS. 2 and 8. Although described later in detail, the movable tray 171 is moved between a first position where the movable tray 171 is bent along an exterior of the main body casing 2 as shown in FIG. 1, and a second position where the movable tray 171 extends forward from the main body casing 2 as shown in FIG. 3.

The following description of the movable tray 171 will be made with a state where the movable tray 171 is located at the second position as a reference.

As shown in FIG. 2, the movable tray 171 includes a first movable shaft 174, a first part 175, a second movable shaft 176, and a second part 177.

The first movable shaft 174, which has a substantially columnar shape extending in the left-right direction, is disposed over the upper surface of the stepped portion 153 of the front wall 52, that is, on the front side of a lower edge of the sheet opening 61, and is rotatably supported at the front ends of the front parts 64 of both of the side walls 50.

The first part 175 has a plate shape, and extends outward in a radial direction of the first movable shaft 174 from the first movable shaft 174. The first part 175 includes a pair of regulation portion grooves 178 and a pair of supply regulation portions 179, as shown in FIG. 8.

The pair of regulation portion grooves 178 are grooves which extend in the left-right direction on the upper surface of the first part 175, and are disposed with an interval therebetween in the left-right direction.

The pair of supply regulation portions 179 are disposed on the upper surface of the first part 175 as shown in FIG. 3. Each of the pair of supply regulation portions 179 has a substantially rectangular plate shape extending in the front-rear direction in a side view. Each of the pair of supply regulation portions 179 is slidable in the left-right direction along the corresponding regulation portion groove 178. The pair of supply regulation portions 179 are interlocked with each other by a link mechanism (not shown), and if one supply regulation portion 179 is slid and moved inward in the left-right direction, the other supply regulation portion 179 is also slid and moved inward in the left-right direction. Furthermore, if one supply regulation portion 179 is slid and moved outward in the left-right direction, the other supply regulation portion 179 is also slid and moved outward in the left-right direction.

The second movable shaft 176 has a substantially columnar shape extending in the left-right direction, and is rotatably supported at an end of the first part 175 on an opposite side to the first movable shaft 174, that is, at a front end thereof.

The second part 177 includes a base portion 182 and an extension portion 183.

The base portion 182 has a substantially rectangular plate shape in a plan view, and extends outward in a radial direction of the second movable shaft 176 from the second movable shaft 176. The base portion 182 includes the base portion opening 184. The base portion opening 184 is disposed from a substantially center of the base portion 182 in the front-rear direction to a rear part thereof at a substantially center of the base portion 182 in the left-right direction. The base portion opening 184 has a substantially rectangular shape extending in a plan view, and penetrates through the base portion 182 in the upper-lower direction. A dimension of the base portion opening 184 in the left-right direction is slightly larger than a dimension of the sheet regulation portion 159 in the left-right direction.

The extension portion 183 has a plate shape extending in the same direction as the base portion 182. The extension portion 183 is slid and moved with respect to the base portion 182 between a retreat position where the extension portion 183 overlaps an upper surface of the base portion 182 as indicated by a dashed line in FIG. 2, and an advance position where the extension portion 183 extends further forward from the base portion 182 as indicated by a solid line in FIG. 2. The extension portion 183 includes the extension portion opening 185.

The extension portion opening 185 is disposed so as to overlap the base portion opening 184 of the base portion 182 in a state where the extension portion 183 is located at the retreat position. Specifically, the extension portion opening 185 has a substantially U shape which is opened rearward in a plan view, and is cut out forward from a substantially center part in the front-rear direction at a rear edge of the extension portion 183. A dimension of the extension portion opening 185 in the left-right direction is the same as a dimension of the base portion opening 184 in the left-right direction.

A dimension of the second part 177 viewed from the left-right direction is larger than a dimension of the first part 175 viewed from the left-right direction in both states where the extension portion 183 is located at the retreat position or the advance position.

Further, the movable tray 171 is rotated between a first position where the movable tray 171 is bent along the exterior of the main body casing 2 so that the second part 177 covers the sheet discharge wall 155 and the front end of the sheet discharge tray 35 as shown in FIG. 1, and a second position where the movable tray 171 extends in a direction which linearly connects the front upper side and the rear lower side in a side view so as to become separated from the main body casing 2 as shown in FIG. 2, with the first movable shaft 174 as a fulcrum.

A downstream surface of the movable tray 171 in the clockwise direction in a left side view is referred to as a front surface 188, and an upstream surface thereof in the clockwise direction in a left side view is referred to as a rear surface 189.

As shown in FIG. 1, in a state where the movable tray 171 is located at the first position, the first part 175 is disposed so as to extend upward from the first movable shaft 174. The second part 177 is disposed so as to extend toward the rear upper side from the upper end of the first part 175, that is, the second movable shaft 176 when the extension portion 183 thereof is located at the retreat position. Thus, the second part 177 covers the upper portion 154 of the front wall 52 and the sheet discharge wall body 157 of the sheet discharge wall 155, and the rear upper end thereof is received by the reception portion 162 of the cover body 79. That is, in a state where the movable tray 171 is located at the first position, the sheet discharge tray 35 is formed by the front surface of the tray wall 66, the upper surface of the cover body 79, and the front surface 188 of the movable tray 171 at the second part 177. Accordingly, the front surface 188 receives a discharged sheet P when the movable tray 171 is located at the first position.

As shown in FIG. 3, in a state where the movable tray 171 is located at the second position, the first part 175 is disposed so as to extend toward the front upper side from the first movable shaft 174. The second part 177 is disposed so as to extend toward the front upper side from the front upper end of the first part 175, that is, the second movable shaft 176 so that an upward inclination thereof is larger than that of the first part 175, when the extension portion 183 thereof is located at the advance position. That is, the movable tray 171 extends substantially linearly in a direction which connects the rear lower side to the front upper side in a side view in a state of being located at the second position. Thus, the movable tray 171 located at the second position allows a sheet P to be placed on the rear surface 189, and thus guides the supply of the sheet P into the main body casing 2 via the sheet opening 61. As mentioned above, the rear surface 189 receives a sheet P which is transported into the main body casing 2 from outside via the sheet opening 61 when the movable tray 171 is located at the second position. In a state where the movable tray 171 is located at the second position, the sheet discharge tray 35 is formed by the front surface of the tray wall 66, the upper surface of the cover body 79, and the upper surface of the sheet discharge wall body 157 of the sheet discharge wall 155.

6. Removing and Mounting Operations of Process Cartridge with Respect to Main Body Casing Next, a removing operation and a mounting operation of the process cartridge 15 with respect to the main body casing 2 will be described.

(1) Removing Operation of Process Cartridge from Main Body Casing

First, a description will be made of a removing operation of the process cartridge 15 from the main body casing 2, that is, a movement of the process cartridge 15 from the internal position to the external position.

As shown in FIG. 1, in a state where the process cartridge 15 is located at the internal position, the rear end of the roller accommodation portion 122 of the drum cartridge 18 is disposed inside the recess portion 104 of the reception part 105, and the left and right ends of the drum shaft 131 are inserted into the lower end of the small width portion 58 of the second groove 56. In the state where the process cartridge 15 is located at the internal position, the protrusion 134 of the drum cartridge 18 is fitted in the engagement portion 82 of the cover guide 80, and the front surface of the grip portion 129 of the handle 115 is in contact with the rear surface of the regulation wall 169 of the scanner unit accommodation portion 163. Thus, the handle 115 is located at the accommodation position where the connection portion 128 extends toward the front upper side from the swing shaft 126, and the grip portion 129 is disposed on the upper side with respect to the swing shaft 126 in the main body casing 2.

In order to move the process cartridge 15 from the internal position to the external position, as shown in FIG. 2, the operator swings the flat bed scanner 40 in the counterclockwise direction in a left side view, and also moves the movable tray 171 from the first position to the second position. At this time, the extension portion 183 of the second part 177 is located at the retreat position, and thus a rotation radius is reduced when the movable tray 171 is rotated with the first movable shaft 174 as a fulcrum. Therefore, it is possible to reduce a displacement amount of the swing of the flat bed scanner 40 in the counterclockwise direction in a left side view. The flat bed scanner 40 is swung so that the movable tray 171 is located at the second position, and then the top cover 77 is moved from the closed position to the open position. Further, a movement of the top cover 77 between the closed position and the open position may be interlocked with the swing of the flat bed scanner 40.

At this time, since the protrusion 134 is fitted in the engagement portion 82, the protrusion 134 is moved toward the rear upper side according to a movement of the top cover 77 from the closed position to the open position. Accordingly, the process cartridge 15 is moved toward the front upper side and rotated in the counterclockwise direction in a left side view about the drum shaft 131 while the left and right ends of the drum shaft 131 are guided by the small width portion 58.

Thus, the process cartridge 15 is located on the upper side with respect to the internal position, and the front upper end of the process cartridge 15 is located at the extraction position which lies outside the main body casing 2, via the process opening 75. That is, the small width portion 58 of the second groove 56 guides a movement of the process cartridge 15 from the internal position to the extraction position.

At this time, the handle 115 is inclined so as to be separated forward from the drum front wall 111 with the swing shaft 126 as a fulcrum by the gravity due to release of contact between the grip portion 129 and the regulation wall 169, and swings from the accommodation position to the ejection position. In a state where the handle 115 is located at the ejection position, the grip portion 129 is located further downstream (upstream in a mounting direction X which is a direction from the front upper side toward the rear lower side) in a removing direction Y which is a direction from the rear lower side toward the front upper side than when the handle 115 is located at the accommodation position, and is located on the upper side of the connection part between the regulation wall 169 and the guide wall 168, outside the main body casing 2. The removing direction Y and the mounting direction X are directions intersecting the left-right direction.

That is, the process cartridge 15 is taken out from the internal position to the extraction position in interlocking with the movement of the top cover 77 from the closed position to the open position, and the handle 115 is moved from the accommodation position to the ejection position in interlocking with the movement of the process cartridge 15 from the internal position to the extraction position.

In a state where the top cover 77 is located at the open position, the guide body 86 of the cover guide 80 extends downstream (upstream in the mounting direction X) in the removing direction Y from the lower end of the regulation portion 81.

In other words, the handle 115 and the guide body 86 of the cover guide 80 are disposed further upstream in the mounting direction X than the rotation shaft 78.

Next, the operator, as shown in FIGS. 2 and 3, holds the grip portion 129 of the handle 115 located at the ejection position, and pulls out the process cartridge 15 toward the front upper side.

Accordingly, the protrusion 134 is moved toward the front upper side so as to be separated from the engagement portion 82 of the guide body 86, and is thus moved onto the first cover guide 83. The left-right ends of the drum shaft 131 are moved toward the front upper side, and are moved from the small width portion 58 to the large width portion 57. Further, the first cover guide 83 guides a movement of the protrusion 134, and the lower edge of the large width portion 57 guides a movement of the left-right ends of the drum shaft 131. Thus, the process cartridge 15 is moved toward the front upper side in the removing direction Y while each of the front upper end and the rear end thereof are guided.

Then, the front end of the process cartridge 15, specifically, the contact portion 117 of the drum front wall 111 is brought into contact with the regulation wall 169 of the accommodation portion top wall 165.

Next, when the operator pulls out the grip portion 129 of the handle 115 further toward the front upper side, the protrusion 134 is moved toward the front upper side, and is moved from on the first cover guide 83 to on the second cover guide 84. The contact portion 117 is moved toward the front upper side so as to reach the guide wall 168, and is slid on the guide wall 168. At this time, the second cover guide 84 guides a movement of the protrusion 134, and the guide wall 168 guides a movement of the contact portion 117.

Thus, the process cartridge 15 is guided further toward the front upper side in the removing direction Y.

Successively, as shown in FIG. 3, when the operator pulls out the grip portion 129 of the handle 115 still further forward, the protrusion 134 is moved forward so as to be moved from on the second cover guide 84 to on the introduction portion 85, and is then separated from the cover guide 80.

At this time, the transfer accommodation wall 113 of the drum frame 23 sequentially reaches the upper side of the guide wall 168 and the regulation wall 169, and is slid on the guide wall 168 and the regulation wall 169. That is, each of the guide wall 168 and the regulation wall 169 guides a movement of the transfer accommodation wall 113. Thus, the rear end of the process cartridge 15 is guided so that the process cartridge 15 is moved forward in the removing direction Y and is removed from the main body casing 2.

Accordingly, the process cartridge 15 is moved from the internal position to the extraction position so as to be then moved from the extraction position downstream (upstream in the mounting direction X) in the removing direction Y and to reach the external position.

That is, the cover guide 80 and the accommodation portion top wall 165 guide the movement of the process cartridge 15 from the extraction position to the external position.

Successively, the operator moves the top cover 77 from the open position to the closed position, and after moving the movable tray 171 from the second position to the first position, swings the flat bed scanner 40 in the clockwise direction in a left side view until the flat bed scanner 40 is brought into contact with the flat bed support wall 65.

In the above-described manner, the removing operation of the process cartridge 15 from the main body casing 2 is completed.

(2) Mounting Operation of Process Cartridge to Main Body Casing

In order to mount the process cartridge 15 to the main body casing 2, procedures are performed in a reverse order to the above-described removing operation.

Specifically, as shown in FIGS. 2 and 3, the operator swings the flat bed scanner 40 in the counterclockwise direction in a left side view, and after moving the movable tray 171 from the first position to the second position, moves the top cover 77 from the closed position to the open position.

Next, the operator holds the handle portion 133 of the drum cartridge 18 and inserts the process cartridge 15 into the main body casing 2 toward the rear lower side through the process opening 75. At this time, the protrusion 134 is located on the introduction portion 85 of the cover guide 80, and the left and right ends of the drum shaft 131 are received by the large width portion 57 of the second groove 56.

Successively, the operator holds the grip portion 129 of the handle 115, and pushes the process cartridge 15 into the main body casing 2 toward the rear lower side. Therefore, the protrusion 134 reaches the upper side of the first cover guide 83 from the introduction portion 85 via the second cover guide 84, and the left-right ends of the drum shaft 131 reach the continuous part of the large width portion 57 and the second groove 56 along the lower edge of the large width portion 57 of the second groove 56. Thus, the drum cartridge 18 is moved toward the rear lower side in the mounting direction X so as to pass over the regulation wall 169 and the guide wall 168 of the sheet discharge wall 155.

As shown in FIG. 2, if the process cartridge 15 is moved further toward the rear lower side, the protrusion 134 reaches the engagement portion 82 so as to be fitted therein, and the rear end of the protrusion 134 is also brought into contact with the regulation portion 81. Further, the left and right ends of the drum shaft 131 reach the continuous part of the large width portion 57 and the small width portion 58.

In the above-described manner, the movement of the drum cartridge 18 from the external position to the extraction position is completed.

That is, the cover guide 80 guides the movement of the process cartridge 15 from the external position to the extraction position.

Next, the operator moves the top cover 77 from the open position to the closed position, and also swings the flat bed scanner 40 in the clockwise direction in a left side view.

At this time, the protrusion 134 is moved toward the rear lower side due to the movement of the top cover 77. Accordingly, the process cartridge 15 is moved toward the rear lower side and rotated in the clockwise direction about the drum shaft 131 in a left side view while the left and right ends of the drum shaft 131 are guided by the small width portion 58. Thus, the process cartridge 15 is moved from the extraction position to the internal position as shown in FIG. 1. That is, the small width portion 58 of the second groove 56 guides the movement of the process cartridge 15 from the extraction position to the internal position.

When the process cartridge 15 is moved from the extraction position to the internal position, the grip portion 129 of the handle 115 is slid on the upper surface of the guide wall 168 of sheet discharge wall 155 as shown in FIG. 2. Thus, the handle 115 is rotated in the counterclockwise direction in a left side view with the swing shaft 126 as a fulcrum so that the grip portion 129 becomes close to the drum front wall 111 from the ejection position.

Further, when the process cartridge 15 reaches the internal position, the handle 115 is located at the accommodation position while the grip portion 129 is disposed to be adjacent to the regulation wall 169 of the sheet discharge wall 155 on the rear side.

That is, the process cartridge 15 is moved from the extraction position to the internal position in interlocking with the movement of the top cover 77 from the open position to the closed position, and the handle 115 is moved from the ejection position to the accommodation position in interlocking with the movement of the process cartridge 15 from the extraction position to the internal position.

In the above-described manner, the mounting operation of the process cartridge 15 to the main body casing 2 is completed.

In the state where the process cartridge 15 is located at the internal position, the process cartridge 15 is disposed on the rear side of the scanner unit 16, and is disposed on the upper side with respect to the second sheet guide 89 with a slight interval therebetween. The toner accommodation portion 139, the supply roller 27, the developing roller 26, and the photosensitive drum 20 are sequentially disposed along the second sheet guide 89 from the front side to the rear side.

That is, in the state where the process cartridge 15 is located at the internal position, the scanner unit 16, the toner accommodation portion 139, the supply roller 27, the developing roller 26, and the photosensitive drum 20 are disposed so as to be sequentially arranged in the front-rear direction from the front side to the rear side.

Further, in the state where the process cartridge 15 is located at the internal position, the contact point N between the drum body 132 of the photosensitive drum 20 and the transfer roller 21 is located on the upper side with respect to the rear end of the second sheet guide 89, and is thus located on the rear upper side with respect to the guide protrusion 103 of the second sheet guide 89.

7. Image Forming Operation (1) Developing Operation

The printer 1 starts an image forming operation under the control of a controller (not shown). When the image forming operation is started, the scorotron charger 22 uniformly charges the surface of the photosensitive drum 20.

Then, the scanner unit 16 emits a laser beam L toward the surface of the photosensitive drum 20 in the rear lower direction. The laser beam L passes under the grip portion 129 of the handle 115, then passes through the laser passing hole 124 of the drum front wall 111, further pass over the developing cartridge 19, and exposes the front circumferential surface of the drum body 132 of the photosensitive drum 20. Thus, an electrostatic latent image based on image data is formed on the circumferential surface of the drum body 132. Incidentally, the image data may include, for example, image data which is transmitted to the printer 1 from a personal computer (not shown) connected to the printer 1, or image data read by the flat bed scanner 40.

Further, the agitator 142 agitates toner in the toner accommodation portion 139 and supplies the agitated toner to the supply roller 27 via the communication hole 141. The supply roller 27 supplies the toner which is supplied from the agitator 142, to the developing roller 26. At this time, the toner is positively friction-charged between the developing roller 26 and the supply roller 27 and is carried on the developing roller 26. The layer thickness regulation blade 28 regulates the toner carried on the developing roller 26 to a constant thickness.

The developing roller 26 supplies the toner which is carried in the constant thickness to the electrostatic latent image on the circumferential surface of the drum body 132. Thus, the toner image is carried on the circumferential surface of the drum body 132.

(2) Sheet Feed Operation

A plurality of sheets P accommodated in the sheet feed cassette 7 are guided to the upstream part 94 and the middle part 95 of the first sheet guide 88, and are moved toward the pair of first transport rollers 100. Specifically, the sheet lift 10 swings in the counterclockwise direction in a left side view with a rear end as a fulcrum, and pinches front ends of the sheets P placed on the upper surface of the sheet lift 10 together with the pickup roller 9.

The pickup roller 9 is rotated, and thus the sheets P are sent toward the sheet feed roller 8. The sheet feed pad 11 guides the ends of the sent sheets P downstream in the transport direction so as to direct the ends thereof toward a gap between the sheet feed roller 8 and the sheet feed pad 11.

Next, the sheet feed roller 8 is rotated, and thus the sheets P which reach between the sheet feed roller 8 and the sheet feed pad 11 are separated one by one. One sheet P separated by the sheet feed roller 8 passes between the sheet feed roller 8 and the first pinch roller 12 so as to be then sequentially guided to the second pinch roller 13 and the curved guide 97, and are transported so as to be returned toward the rear upper side.

Next, the sheet P is guided to the upper surface of the linear guide 98 so as to reach between the pair of first transport rollers 100.

On the other hand, if sheet sheets P are to be supplied from outside of the main body casing 2, the operator places the sheet sheets P on the rear surface 189 of the movable tray 171 located at the second position. Therefore, the sheet sheets P are moved toward the rear lower side along the inclination of the second part 177. Thus, rear ends of the sheet sheets P are located inside the main body casing 2 via the sheet opening 61, and come into contact with the front lower end of the transport roller 192. The pair of supply regulation portion 179 comes into contact with both left and right ends of rear parts of the sheets P, and regulates a movement of the sheets P in the left-right direction.

The transport roller 192 is rotated, and thus the sheets P are sent toward the sheet feed roller 193. Therefore, the sheets P reach between the sheet feed roller 193 and the pad 194.

Next, the sheet feed roller 193 is rotated, and thus the sheets P which reach between the sheet feed roller 193 and the pad 194 are separated one by one, so as to be sent toward the pair of first transport rollers 100. Then, one sheet P separated by the sheet feed roller 193 reaches between the pair of first transport rollers 100.

The pair of first transport rollers 100 sends the sheet P to an interval between the pair of inclined guides 99 so as to transport the sheet P toward a gap between the pair of second transport rollers 101. The pair of inclined guides 99 guides a movement of the sheet P which is directed toward the rear lower side. Thus, the sheet P reaches between the pair of second transport rollers 101.

Successively, the pair of second transport rollers 101 sends the sheet P to a gap between the process cartridge 15 located at the internal position and the second sheet guide 89 so that the sheet P is transported toward the contact point N between the photosensitive drum 20 and the transfer roller 21. Accordingly, the sheet P is moved rearward along the upper surface of the second sheet guide 89.

Then, a leading end of the sheet P in the transport direction comes into contact with the guide protrusion 103. Thus, the transport direction of the sheet P is changed so as to be directed toward the rear upper side, and the sheet P is supplied to the sheet feed path 135 of the process cartridge 15.

The sheet P supplied to the sheet feed path 135 is transported toward the contact point N between the drum body 132 and the transfer roller 21 so as to pass through the contact point N. At this time, the transfer roller 21 transfers a toner image onto the sheet P from the photosensitive drum 20 so as to form the toner image on the sheet P.

The sheet P on which the toner image is formed is discharged through the sheet discharge opening 136 of the process cartridge 15, and is guided by the third sheet guide 90 so as to be moved toward the fixing unit 17. The sheet P passes between the heating roller 30 and the pressing roller 31. At this time, the heating roller 30 and the pressing roller 31 heat and press the sheet P so that the toner image is thermally fixed to the sheet P.

The sheet P to which the toner image is fixed passes through the pair of guide rollers 33 so as to be guided to the concave portion 106 of the fourth sheet guide 91, and is transported so as to be returned toward the front lower side and to reach between the pair of sheet discharge rollers 34.

The pair of sheet discharge rollers 34 are rotated, and thus the sheet P is discharged on the sheet discharge tray 35 through the sheet discharge port 68. The sheet P on which the toner image is formed and which is discharged from the main body casing 2 is placed on the sheet discharge tray 35.

As described above, the sheet P accommodated in the sheet feed cassette 7 is transported along the transport path T with a substantially S shape in a side view, which is defined by the sheet guide section 6.

8. Operations and Effects (1) According to the printer 1, as shown in FIG. 3, in a case where the movable tray 171 is used, when the movable tray 171 is located at the second position, the movable tray 171 receives a sheet P, and the sheet P can be supplied into the main body casing 2 via the sheet opening 61 of the front wall 52.

Further, as shown in FIG. 1, the movable tray 171 covers the front wall 52 of the main body casing 2 and the sheet discharge wall body 157 of the sheet discharge wall 155, and the rear upper end thereof is received by the reception portion 162 of the cover body 79, at the first position. That is, when the movable tray 171 is not used, the movable tray 171 can be accommodated while being located at the first position.

Therefore, the movable tray 171 does not extend in the vertical direction, and thus it is possible to achieve size-reduction of the printer 1 in the vertical direction.

(2) According to the printer 1, as shown in FIG. 3, a sheet P is placed on the movable tray 171 located at the second position, and thus the sheet P can be reliably supplied into the main body casing 2 via the sheet opening 61 of the front wall 52.

(3) According to the printer 1, as shown in FIG. 8, the movable tray 171 is divided into two members including the first part 175 and the second part 177, and thus the movable tray 171 can be easily folded back.

Therefore, when the movable tray 171 is located at the first position, the second part 177 is folded back toward the sheet discharge section 5, and thus it is possible to achieve size-reduction of the printer 1 in the vertical direction.

(4) According to the printer 1, as shown in FIG. 1, when the movable tray 171 is located at the first position, the reception portion 162 of the top cover 77 receives the rear upper end of the second part 177, and thus the second part 177 can be configured as part of the sheet discharge section 5.

Therefore, even if the movable tray 171 is located at the first position, and the second part 177 is folded back toward the sheet discharge section 5, a sheet P can be discharged from the main body casing 2 without the second part 177 hindering the sheet P from being placed on the sheet discharge section 5.

(5) According to the printer 1, as shown in FIG. 3, the first part 175 and the second part 177 of the movable tray 171 located at the second position extend substantially linearly when viewed from the left-right direction.

Therefore, a sheet P can be stably placed on the movable tray 171 located at the second position.

As a result, the sheet P can be reliably supplied into the main body casing 2 via the sheet opening 61.

(6) According to the printer 1, as shown in FIG. 8, when a sheet P is placed on the movable tray 171 located at the second position, the supply regulation portion 179 can prevent an image formed on the sheet P from being displaced in the left-right direction due to a movement of the sheet P in the left-right direction.

Therefore, the sheet P can be more reliably supplied into the main body casing 2 via the sheet opening 61.

(7) According to the printer 1, as shown in FIG. 1, it is possible to prevent a discharged sheet P from falling down by using the sheet regulation portion 159 which is disposed so as to pass through the base portion opening 184 and the extension portion opening 185 even if the movable tray 171 is located at the first position.

Therefore, it is possible to regulate falling of the sheet P discharged to the sheet discharge section 5 by using the sheet regulation portion 159 even if the movable tray 171 is located either the first position or the second position.

(8) According to the printer 1, as shown in FIG. 1, when the movable tray 171 is located at the first position, the second part 177 longer than the first part 175 can be folded back toward the sheet discharge section 5 when viewed from the left-right direction.

Therefore, when viewed from the left-right direction, the relatively long second part 177 of the movable tray 171 is disposed along the sheet discharge wall body 157 of the sheet discharge wall 155, that is, folded back in a direction which connects the front lower side and the rear upper side, and thus the printer 1 can be size-reduced in the vertical direction even if the movable tray 171 is located at the first position.

(9) According to the printer 1, as shown in FIG. 1, when the movable tray 171 is located at the first position, a discharged sheet P can be received by using the front surface 188, and, as shown in FIG. 3, when the movable tray 171 is located at the second position, a sheet P which is supplied into the main body casing 2 from outside via the sheet opening 61 can be received by using the rear surface 189.

Therefore, both surfaces of the movable tray 171 can be used.

(10) According to the printer 1, as shown in FIG. 2, even if the flat bed scanner 40 is provided on the upper side with respect to the main body casing 2, in the movable tray 171, the second part 177 is rotated with the second movable shaft 176 as a fulcrum in a state where the extension portion 183 is located at the retreat position, and thus it is possible to reduce a rotation radius.

Therefore, the movable tray 171 can be moved between the first position and the second position without interfering with the flat bed scanner 40 simply by slightly swinging the flat bed scanner 40.

Therefore, it is possible to prevent a size of the printer 1 in the vertical direction even if the flat bed scanner 40 is provided.

Incidentally, in this illustrative embodiment, the printer 1 is an example of an image forming apparatus; the main body casing 2 is an example of a casing; the sheet feed cassette 7 is an example of a cassette; the sheet discharge tray 35 is an example of a discharge portion; and the flat bed scanner 40 is an example of an image reading section. Further, the front wall 52 is an example of one side wall; the sheet opening 61 is an example of a first opening; the sheet regulation portion 159 is an example of a second regulation portion; the reception portion 162 is an example of a reception portion. The movable tray 171 is an example of a tray; the first part 175 is an example of a first part; and the second part 177 is an example of a second part. The supply regulation portion 179 is an example of a first regulation portion; the base portion opening 184 and the extension portion opening 185 are an example of a second opening; the front surface 188 is an example of a first surface; and the rear surface 189 is an example of a second surface.

What is claimed is:

1. An image forming apparatus comprising:

a casing including:

one side wall extending in a vertical direction and having a first opening; and a tray disposed near the one side wall and configured to receive a sheet so as to be transported into the casing through the first opening, the tray having a front surface and a rear surface;

a sheet transporting path along which the sheet is transported;

a photosensitive body arranged within the casing in a first height range;

a toner accommodation portion configured to accommodate toner;

a developing device including a developing roller;

an exposure unit configured to expose the photosensitive body and to emit a laser beam toward the photosensitive body such that the laser beam travels along an irradiating path, the exposure unit being disposed at a position between the one side wall and the photosensitive body and being arranged within the casing in a second height range that at least partially overlaps with the first height range; and a sheet feed roller configured to feed the sheet, received by the tray, toward the photosensitive body along the sheet transporting path, the sheet feed roller being disposed at a position closer to the exposure unit than to the photosensitive body, the sheet feed roller, the exposure unit, and the photosensitive body being disposed along the sheet transporting path in this order, wherein the tray is configured to be movable between a first position at which the tray uncovers the first opening and a second position at which the tray covers the first opening, and wherein, in a state where the tray is at the first position, the rear surface of the tray serves as part of the sheet transporting path, and the developing device is allowed to be detachable from the casing along an imaginary path that is defined to pass above the exposure unit.

2. The apparatus according to claim 1, wherein the casing further includes:

a discharge portion configured to receive a sheet having a developer image formed thereon by the developing device, and wherein the tray is configured to be rotatable between a first position where the tray is bent so as to cover at least part of the one side wall and the discharge portion of the casing and a second position where the tray extends so as to be separated from the one side wall of the casing.

3. The apparatus according to claim 2, wherein the tray includes:

a first part which, when the tray is in the first position, extends substantially upward in the vertical direction and covers the one side wall of the casing in a sheet discharge direction; and a second part rotatably connected to the first part and which, when the tray is in the first position, extends so as to be folded back toward the discharge portion from substantially an upper end of the first part in the vertical direction and covers the discharge portion of the casing when viewed from above.

4. The apparatus according to claim 1 further comprising:

an image forming unit that is configured to form an image on the sheet at an image forming position, the image forming unit including the photosensitive body, the toner accommodation portion and the developing device;

a sheet feed cassette that is disposed at a lower part of the casing and that is configured to accommodate a stack of sheets including the sheet;

a sheet feed roller configured to feed a sheet toward the photosensitive body;

a pickup roller that feeds the sheet from the sheet feed cassette toward the sheet feed roller in a first direction;

a sheet conveying path along which the sheet passed through the sheet feed roller is conveyed in a second direction that is opposite to the first direction, the sheet conveying path passing between the toner accommodation portion and the sheet feed cassette; and a sheet discharge path along which the sheet on which the image is formed by the image forming unit is conveyed and discharged from the casing.

5. The apparatus according to claim 4, wherein the sheet conveying path is configured to have a lowest position at a bottom face of the image forming unit.

6. The apparatus according to claim 1, wherein the sheet feed roller is disposed at a first position in a first height range from a bottom of the casing, wherein the exposure unit is disposed at a second position in the first height range, and wherein the photosensitive body is disposed at a third position in the first height range.

7. The apparatus according to claim 1, wherein the sheet feed roller is disposed at a first position in a first depth range from the one side wall of the casing, and wherein the exposure unit is disposed at a second position in a second depth range from the one side wall of the casing, the second depth range being deeper from the one side wall of the casing than the first depth range.

8. The apparatus according to claim 1, wherein the toner accommodation portion is configured to be detachable from the casing.

9. The apparatus according to claim 1, wherein the tray is rotated with a rotation center located on a lower side in the vertical direction with respect to the first opening.

10. The apparatus according to claim 3, wherein the casing includes a recessed reception portion configured to receive a part of the second part of the tray.

11. The apparatus according to claim 3, wherein the first part and the second part of the tray extend substantially linearly as viewed from a rotation axis direction of the tray when the tray is located at the second position.

12. The apparatus according to claim 3, wherein the first part includes a first regulation portion configured to regulate a movement of the sheet in a rotation axis direction of the tray.

13. The apparatus according to claim 3, wherein the discharge portion includes a second regulation portion configured to prevent a sheet which is discharged to the discharge portion from falling down, and wherein the second part includes a second opening through which the second regulation portion passes when the tray is located at the first position.

14. The apparatus according to claim 2 further comprising:

an image reading section configured to read image information of an original document at a position located on an upper side in the vertical direction with respect to the casing.

15. The apparatus according to claim 14, wherein the tray is configured to pass under the image reading section when moving from the first position to the second position.

16. The apparatus according to claim 2, wherein when the tray is in the first position, an upper surface of the tray is coplanar with an upper surface of the discharge portion.

* * * * *